US007568458B2

(12) United States Patent
Roth et al.

(10) Patent No.: US 7,568,458 B2
(45) Date of Patent: Aug. 4, 2009

(54) VALVE EVENT REDUCTION THROUGH OPERATION OF A FAST-ACTING CAMSHAFT PHASER

(75) Inventors: David B. Roth, Groton, NY (US); Braman Wing, Interlaken, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 11/721,679

(22) PCT Filed: Jan. 18, 2006

(86) PCT No.: PCT/US2006/002085

§ 371 (c)(1),
(2), (4) Date: Jun. 14, 2007

(87) PCT Pub. No.: WO2006/078935

PCT Pub. Date: Jul. 27, 2006

(65) Prior Publication Data

US 2008/0092837 A1 Apr. 24, 2008

Related U.S. Application Data

(60) Provisional application No. 60/644,789, filed on Jan. 18, 2005.

(51) Int. Cl.
*F10L 1/34* (2006.01)

(52) U.S. Cl. ..... 123/90.17; 123/90.15; 464/160

(58) Field of Classification Search ..... 123/90.15, 123/90.16, 90.17, 90.18, 90.12, 90.13; 464/1, 464/2, 160

See application file for complete search history.

(56) References Cited

U.S. PATENT DOCUMENTS 5,161,497 A 11/1992 Simko et al.

(Continued)

FOREIGN PATENT DOCUMENTS

DE 4415524 11/1994

(Continued)

OTHER PUBLICATIONS

Lancefield, T.M et al; 1993; "The Practical Application and Effects Of A Variable Event Valve Timing System"; SAE Technical Paper Series—930825; pp. 71-80.

(Continued)

*Primary Examiner*—Ching Chang
(74) *Attorney, Agent, or Firm*—Brown & Michaels, PC

(57) ABSTRACT

A variable cam timing system for an engine with at least one camshaft comprising: a housing, a rotor, and a controlled bypass. The housing has an outer circumference for accepting drive force and chambers. The rotor has a connection to a camshaft coaxially located within the housing. The housing and the rotor define at least one vane separating a chamber in the housing into advance and retard chambers. The vane is capable of rotation to shift the relative angular position of the housing and the rotor. The controlled bypass provides fluid communication between the chambers. When the valve is closed, the valve blocks passage between the chambers and when the valve is open fluid flows through the passage extending between the advance chamber to the retard chamber. A method for reducing the valve event is also disclosed.

13 Claims, 21 Drawing Sheets

U.S. PATENT DOCUMENTS

| | | | | |
|---|---|---|---|---|
| 5,297,507 | A | 3/1994 | Ma | |
| 5,367,992 | A | 11/1994 | Butterfield et al. | |
| 5,809,955 | A * | 9/1998 | Murata et al. | 123/90.17 |
| 6,170,474 | B1 | 1/2001 | Israel | |
| 6,405,694 | B2 | 6/2002 | Sato | |
| 2003/0121484 | A1 | 7/2003 | Wang | |
| 2004/0107929 | A1 | 6/2004 | Machida et al. | |
| 2004/0129250 | A1 | 7/2004 | Iizuka et al. | |
| 2004/0129254 | A1 | 7/2004 | Leiby et al. | |
| 2006/0243235 | A1 | 11/2006 | Schwarzenthal | |

FOREIGN PATENT DOCUMENTS

| | | |
|---|---|---|
| DE | 19804942 | 8/1999 |
| EP | 0801213 | 10/1997 |
| EP | 1355047 | 10/2003 |
| WO | WO9707324 | 2/1997 |
| WO | WO 2004/055336 | 7/2004 |

OTHER PUBLICATIONS

Kidokoro, T. et al; 2003; "Development of PZEV Exhaust Emission Control System"; SAE Technical Paper Series—2003-01-0817; 13 pages.

* cited by examiner

VALVE EVENT REDUCTION THROUGH OPERATION OF A FAST-ACTING CAMSHAFT PHASER

REFERENCE TO RELATED APPLICATIONS

This application claims one or more inventions which were disclosed in PCT Application No. PCT/US2006/002085 filed Jan. 18, 2006, entitled, "VALVE EVENT REDUCTION THROUGH OPERATION OF A FAST-ACTING CAMSHAFT PHASER" which claims priority from Provisional Application No. 60/644,789, filed Jan. 18, 2005, entitled "VALVE EVENT REDUCTION THROUGH OPERATION OF A FAST-ACTING CAMSHAFT PHASER". The benefit under 35 U.S.C. 365, and the aforementioned application is hereby incorporated herein by reference.

BACKGROUND OF THE INVENTION

1. Field of the Invention

The invention pertains to the field of valve event reduction. More particularly, the invention pertains to valve event reduction through operation of a fast-acting cam phaser.

2. Description of Related Art

For engines with a fixed geometry camshaft actuated inlet and exhaust valves, a variable cam timing (VCT) phaser is useful for improving engine operation. Since most VCT phasers are relatively slow acting devices, they can advance or retard the camshaft, but to change between the positions, will take numerous engine cycles to accomplish, even at engine cranking speeds.

To vary the valve event or more specifically, shorten the effective intake or exhaust valve event, numerous methods have been implemented in the prior art, for example U.S. Pat. No. 5,297,507 discloses a method of reducing the valve event by varying the angular velocity of the camshaft. A variable event timing mechanism has a flexible lost motion coupling (valve spring) interposed between the drive wheel and the camshaft. For the camshaft to open normally and close early, the camshaft rotates at substantially the same speed as the drive wheel during opening and closing of the valve. The camshaft is accelerated by the valve spring to lead the drive wheel and thereby reduce the duration of the valve event. For the camshaft to open late and close normally, the camshaft is retarded by the valve spring to lag behind the drive wheel, and during closing of the valve, the camshaft rotates at substantially the same speed as the drive wheel, thereby reducing the duration of the valve event.

U.S. Pat. No. 6,405,694 discloses an exhaust valve advanced-closing control for controlling the valve closing timing of the exhaust valve to the advance side without using valve overlap of a valve timing control means. In a second embodiment, a changeover may be made between the exhaust valve advanced-closing control for controlling the timing to close the exhaust valve to the advance side of the intake TDC and the retarded exhaust valve closing control for controlling the timing to close the exhaust valve to the retard side of the TDC.

US 2003/0121484A1 discloses a method of altering the continuously variable valve timing, lift, and duration by altering the location of the pivot of a rocker arm. The overlap and valve lift duration increases when the valve lift increases. The chain timing, lift and duration are continuous and a function of engine speed.

SAE Technical Paper No. 930825 discloses a variable event timing system that varies both the event length and phasing to optimize the breathing cycle of the engine. A drive shaft replaces an existing camshaft and uses the original drive flange configuration to drive each of the camshafts via a peg that engages with a drive slot in each of the camshafts. The drive shaft transmits torque and runs in its own bearing housings that are moved offset from the drive centerline relative to the camshaft centerline. By applying the offset drive shaft to drive the camshafts, the force applied is of a variable velocity, which accelerates and decelerates the individual camshafts during a single cam revolution. By adjusting the relationship of the drive shaft and the camshaft, the valves open late and close early, shortening the intake valve duration.

SUMMARY OF THE INVENTION

A variable cam timing system for an engine with at least one camshaft comprising: a housing, a rotor, and a controlled bypass. The housing has an outer circumference for accepting drive force and chambers. The rotor has a connection to a camshaft coaxially located within the housing. The housing and the rotor define at least one vane separating a chamber in the housing into advance and retard chambers. The vane is capable of rotation to shift the relative angular position of the housing and the rotor. The controlled bypass provides fluid communication between the chambers. When the valve is closed, the valve blocks passage between the chambers and when the valve is open, fluid flows through the passage extending between the advance and the retard chamber, allowing the phaser to be rapidly actuated to a full retard position prior to peak valve lift, which then causes the camshaft torque to rapidly advance the phaser during the closing half of the valve event or zero lift.

A method for varying the phase of the camshaft relative to the crankshaft with a variable cam timing phaser for an internal combustion engine is also disclosed. In a first step the duration, the phase of the cams camshaft relative to the crankshaft is changed, such that the duration of the valve opening is varied and the valve reaches a first center. In a second step, the phase is shifted in an opposite direction by operating the phaser during valve closing until the valve reaches a second center. The phase may be lengthened or shortened.

DETAILED DESCRIPTION OF THE INVENTION

Figure 1:
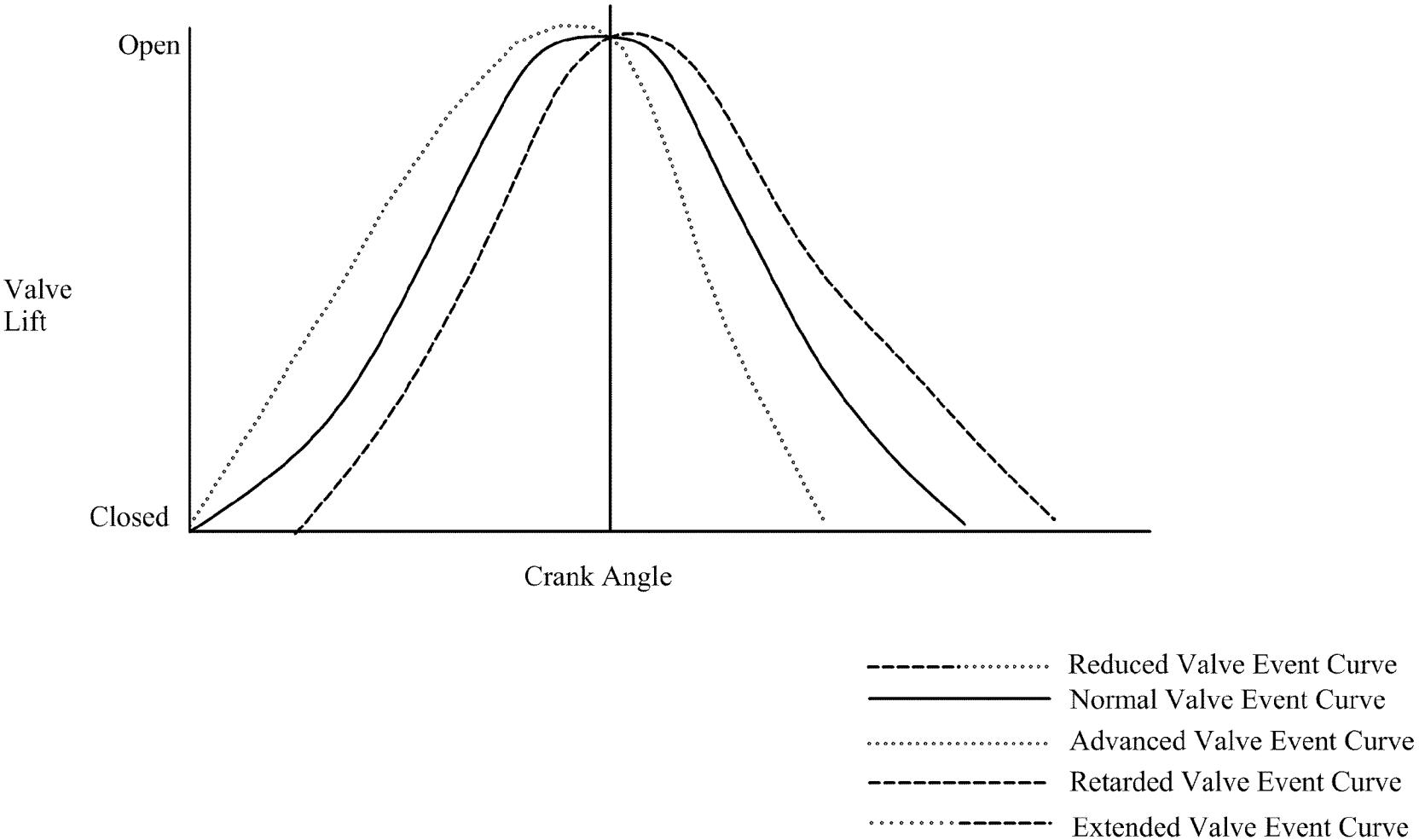
FIG. 1 is a graph showing valve timing characteristics.

Referring to FIGS. 1 through 6, the steps for reducing the valve event duration are disclosed using a variable cam timing (VCT) phaser that may be actuated rapidly enough, such that the camshaft is set to the fully retard position prior to peak valve lift, which then causes the camshaft torque, oil pressure or a combination of both to rapidly advance the camshaft during the closing half of the valve event. Therefore, as shown in FIG. 1, the reduced valve event curve (shown by the dashed, dotted line) results and the opening of the valve is retarded the closing is advanced within one valve event.

If no alterations were made to the valve event, typical opening and closing of the valve is shown by the normal valve event curve line illustrated as the unbroken line. If the opening of the valve is advanced, the valve opens earlier than the normal curve, and closes prior to the normal curve, as illustrated by the dotted line. If the opening of the valve is retarded, the valve opens later than the normal curve and closes after the normal curve, as illustrated by the dashed line. The reduced valve event curve that results from the method of the present invention is a combination of the retard valve event curve opening of the valve and the advance valve event closing of the valve, illustrated by the dashed, dotted line. As shown by the reduced valve event curve, the duration of the valve event is significantly shorter than the normal valve event, the reduced valve event, or the advance valve event.

Figure 6:
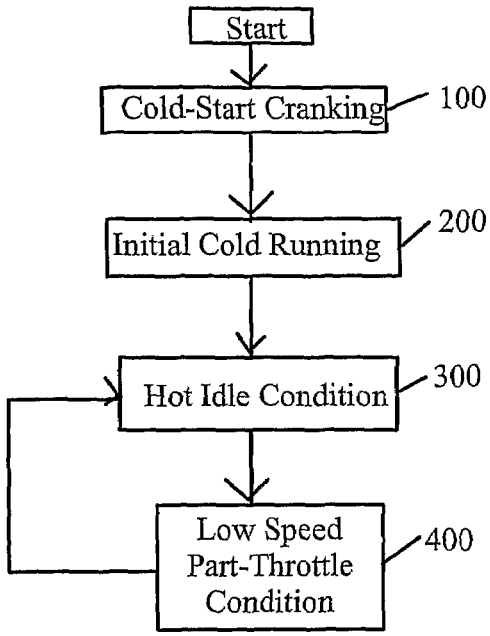
FIG. 6 shows a flowchart of how the conditions of the engine are related.

FIG. 6 shows the engine conditions and the relationship among the conditions. The first engine condition is cold-start cranking 100. This condition occurs when the engine is started when it is "cold" and trying to turn over. After the engine has started, the engine is in initial cold running 200, which includes the first several firing engine cycles. After the engine has been running for sometime, the engine is in hot idle condition 300. In this condition, the engine is warm enough to vaporize liquid fuel droplets and an increase in speed is not present. Next, the engine is in low speed part-throttle condition 400, which applies to the engine during an increase in speed, until the top speed of the engine is reached and valve event reduction may be accomplished.

Figure 2:
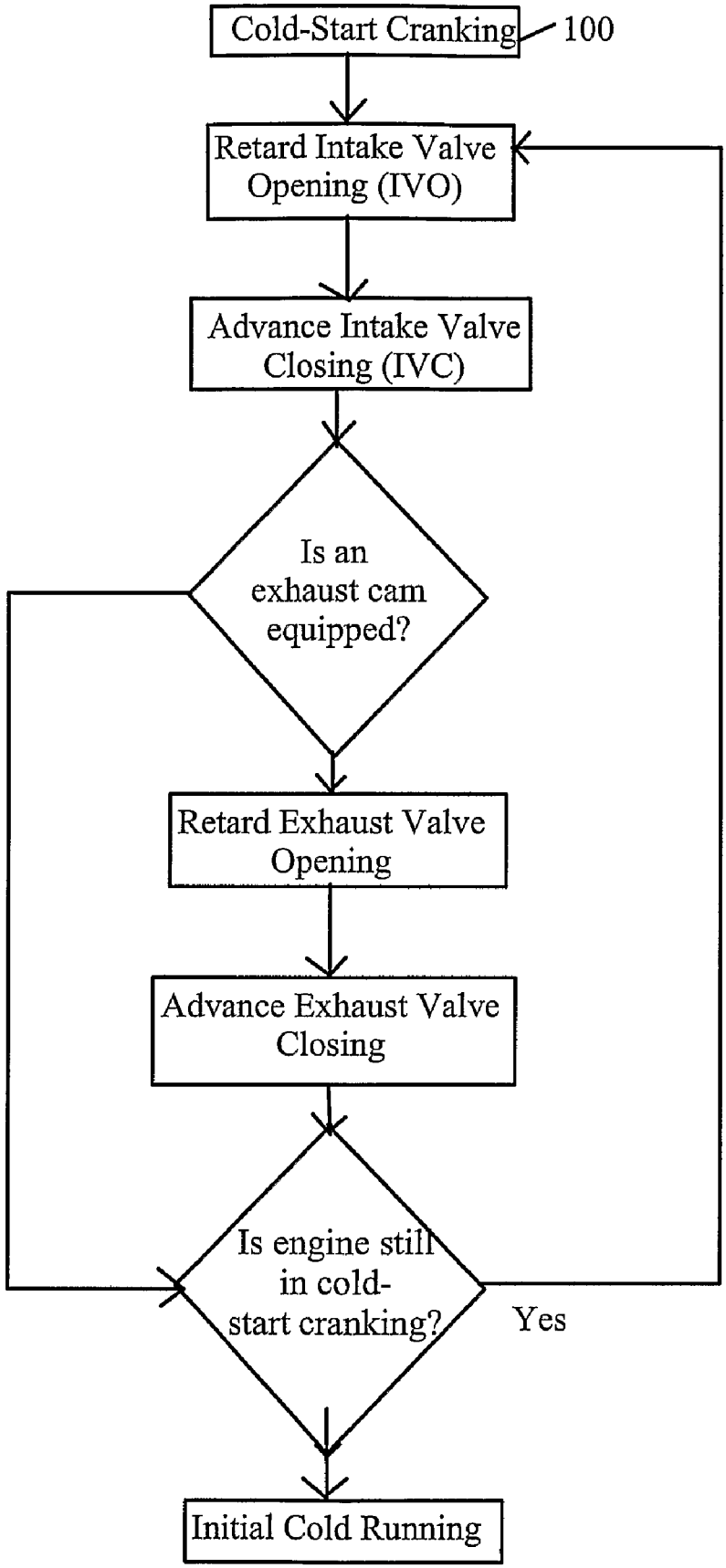
FIG. 2 shows a flowchart of the steps associated with cold-start cranking of the engine.

FIGS. 2 through 5 show individual steps of each of the engine conditions necessary to reduce the valve event duration. FIG. 2 shows the steps for reducing the valve event duration during cold-start cranking 100. During cold-start cranking of a conventional phaser, a compromise between the benefit of enhanced mixture preparation from the retarded intake valve opening and the deterioration of the combustion quality due to the reduced compression ratio from the retarded intake closing occurs. In the present invention, an emissions benefit is present for at least the first few cranking and firing cycles. The first step of when the engine is in the cold-start cranking condition 100 is to retard the intake valve opening (IVO) to the maximum limit of the phaser, such that the intake valve opening occurs after top dead center (TDC). This allows a period of high air velocity to move past the intake valve seat as the valve opens and the piston velocity is increasing, resulting in enhancement of fuel-air mixing when the engine components are too cold to thermally vaporize liquid fuel drops, yielding an improvement in hydrocarbon emissions during the first firing engine cycles. During the same engine cycle, the intake valve closing (IVC) is advanced, such that the closing of the valve is near bottom dead center (BDC). By closing the valve near bottom dead center, as much of the effective compression ratio is preserved as possible, which helps combustion since it maximizes the peak mixture temperature prior to ignition. If the engine is equipped with an exhaust cam phaser, the exhaust valve opening is retarded. This will reduce the valve overlap further and therefore the burned gas fraction, aiding in combustibility of the fuel/air mixture. The closing of the exhaust valve may also need to be advanced. If the engine has not sufficiently warmed enough to proceed to initial cold running, the steps shown in FIG. 2 are repeated.

Figure 3:
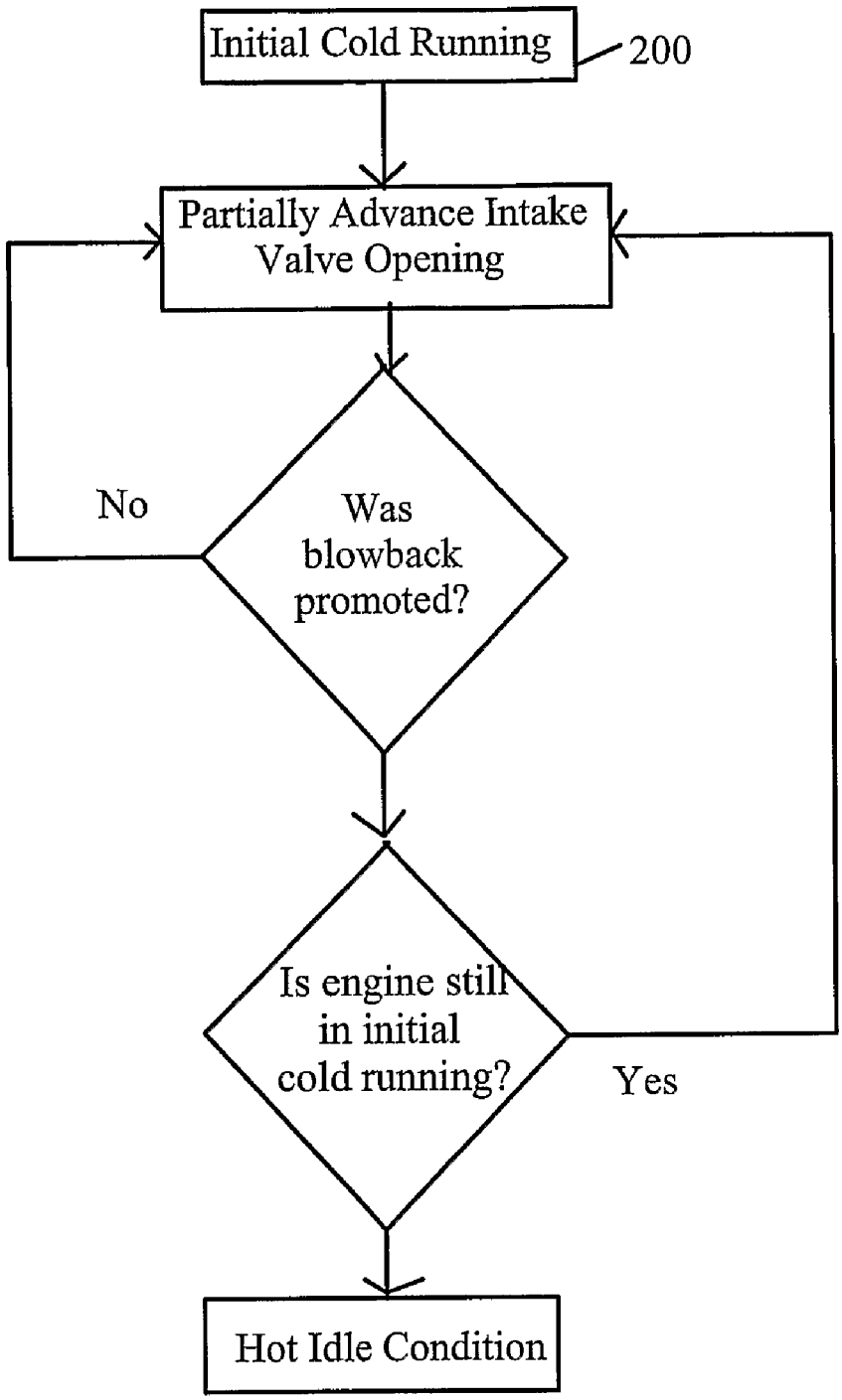
FIG. 3 shows a flowchart of the steps associated with initial cold running of the engine.

FIG. 3 shows the steps for reducing the valve event duration during initial cold running 200 of the engine. The first step is to partially advance the intake valve opening to promote blowback or the back flow of the charge due to the movement of the air/fuel mixture through the intake valve and into the intake port. The intake valve closing would also be advanced partially. Assuming that the engine is equipped with an exhaust cam phaser, the exhaust valve closing is advanced. By promoting the blowback of the charge, which contains a portion of burned gas from the previous cycle, heating of the intake valve and vaporization of the fuel/air mixture is increased. If the engine is not sufficiently warmed enough to thermally vaporize liquid fuel droplets, the steps shown in FIG. 3 are repeated.

Figure 4:
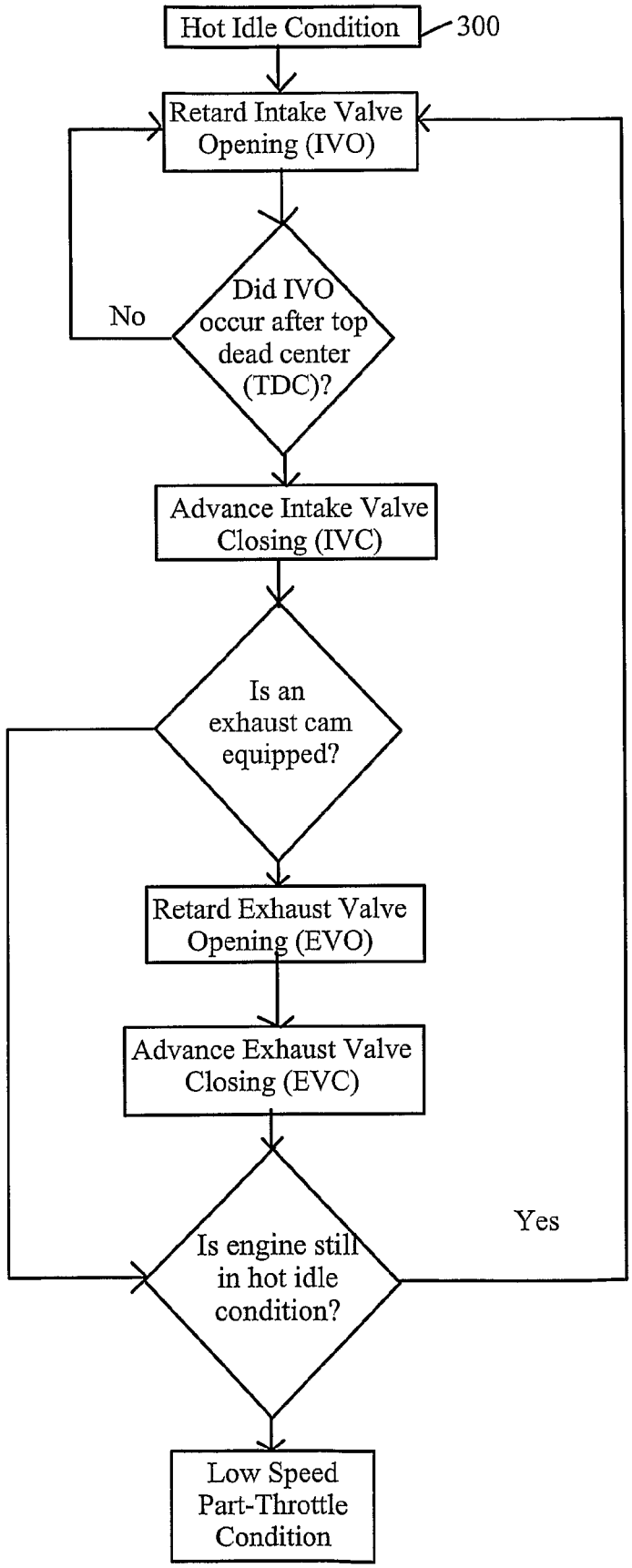
FIG. 4 shows a flowchart of the steps associated with hot idle condition of the engine.

FIG. 4 shows the steps for reducing the valve event duration during hot idle 300 of the engine. The first step is to retard the intake valve opening (IVO) to the maximum limit of the phaser such that the intake valve opening occurs after top dead center (TDC). If the intake valve opening (IVO) occurs at or near top dead center, the intake valve closing (IVC) is advanced, such that the closing of the valve is near bottom dead center (BDC). By retarding the intake valve opening and advancing the intake valve closing, the combustion stability and fuel consumption, due to pumping losses, is improved. If the engine is equipped with an exhaust cam phaser, the exhaust valve opening is retarded. Next, the exhaust valve closing is advanced. The combination of the retarded exhaust valve opening and the advanced exhaust valve closing provides increased fuel economy and minimization of the burned gas fraction leading to good combustion stability. If the engine is still idling, the steps shown in FIG. 4 are repeated, if not then the engine moves to the low speed part-throttle condition.

Figure 5:
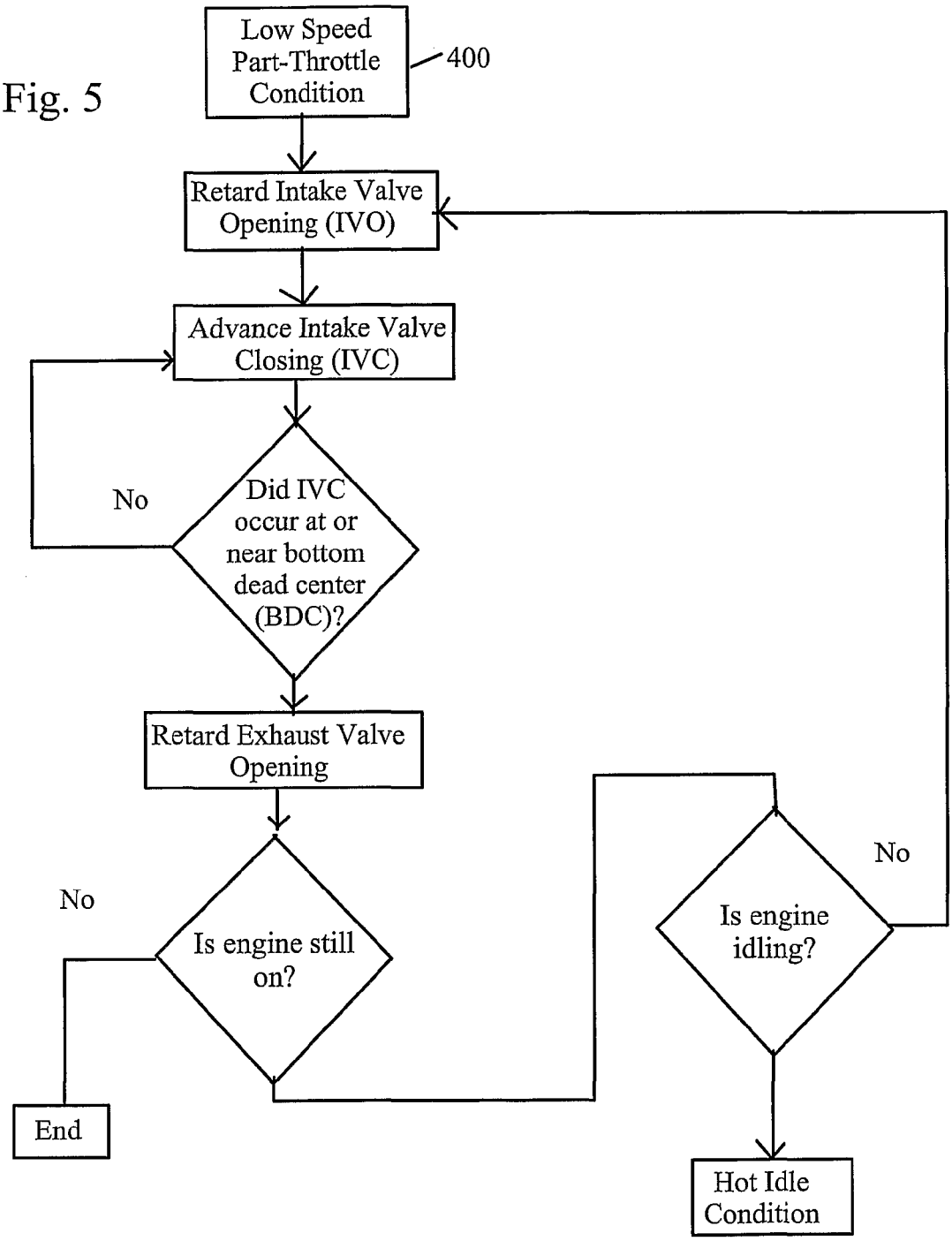
FIG. 5 shows a flowchart of the steps associated with low speed part-throttle condition of the engine.

FIG. 5 shows the steps for reducing valve event duration during the low speed part-throttle 400 condition of the engine. The low speed part-throttle condition of the engine applies up until the top speed of the reduction of the valve event duration may be accomplished, since it is limited by the dynamics of response of the phaser and the camshaft. First, the intake valve opening is retarded to the maximum limit of the phaser, such that the intake valve opening occurs after top dead center (TDC). During the same engine cycle, the intake valve closing (IVC) is advanced, such that the closing of the valve is near bottom dead center (BDC). Once the intake valve closing (IVC) occurs at or near bottom dead center (BDC), the exhaust valve opening is retarded. The exhaust valve closing is also retarded, thereby increasing valve overlap, which increases the exhaust gas ratio or high burn gas fraction reduces hydrocarbon emissions and improves fuel consumption The above steps for reducing the valve event duration may be applied to and carried out by the phasers shown in FIGS. 7*a* through 13*d*. The variable cam timing phasers shown in FIGS. 7*a* through 13*d* may be actuated rapidly enough, such that the camshaft is moved to the full retard position prior to peak valve lift, which then causes the camshaft torque, oil pressure or a combination of both to rapidly advance the camshaft during the closing half of the valve event or zero lift.

Figure 7A:
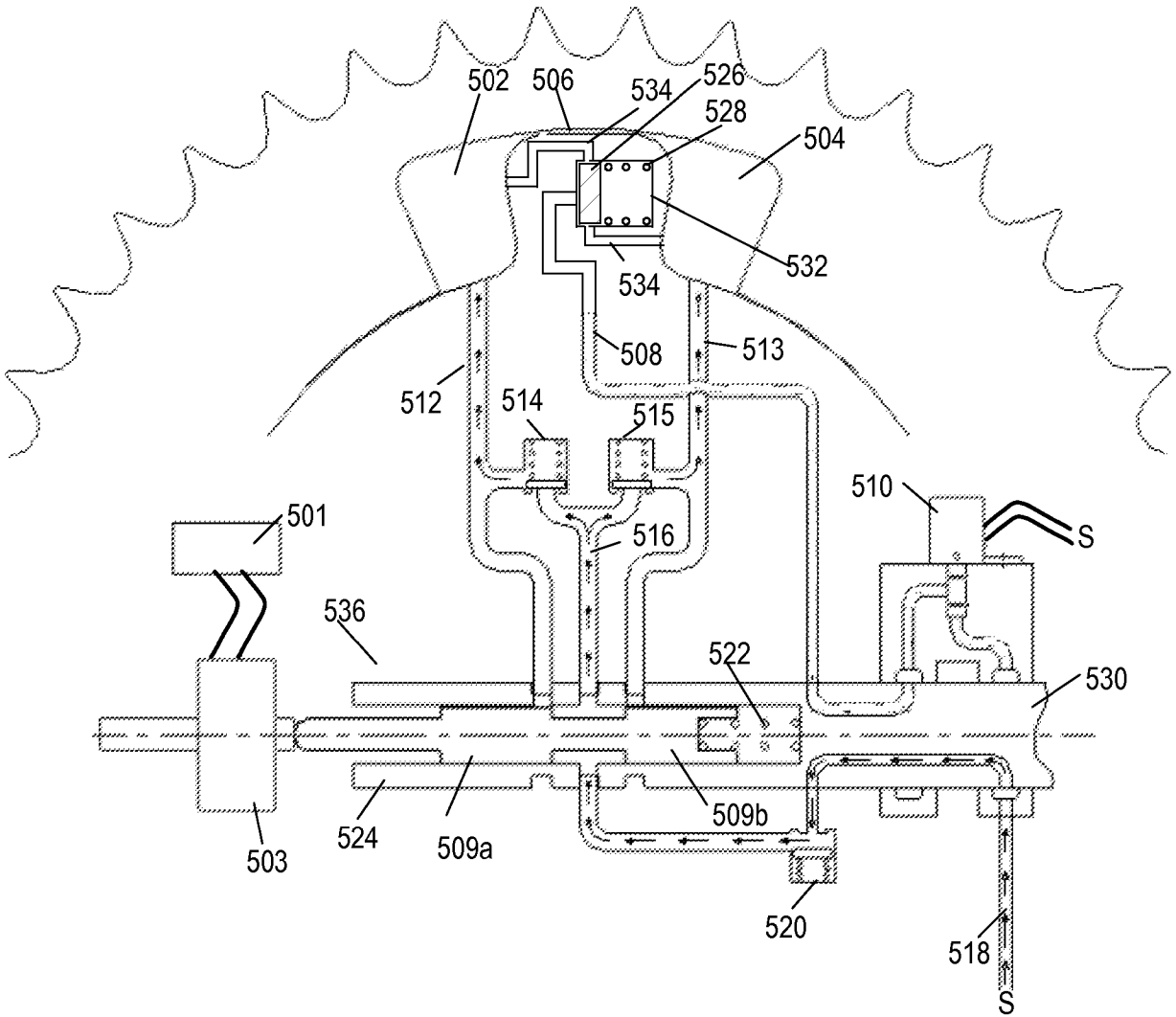
FIG. 7*a* shows a schematic of a phaser with a pressure-actuated valve in the closed position.

FIG. 7*a* shows a schematic of a cam torque actuated phaser in the null position with a pressure-actuated valve in the vane 506 in the closed position. In a conventional cam torque actuated phaser (CTA) torque reversals in the camshaft 530 caused by the forces of opening and closing engine valves move the vanes 506. The control valve 536 in a CTA system allows the vanes 506 in the phaser to move by permitting fluid flow from the advance chamber 502 to the retard chamber 504 or vice versa, depending on the desired direction of movement. Cam torsionals are used to advance and retard the phaser (not shown). In the null position, the vane is locked in position. Makeup fluid is supplied to the phaser as is necessary.

Figure 7B:
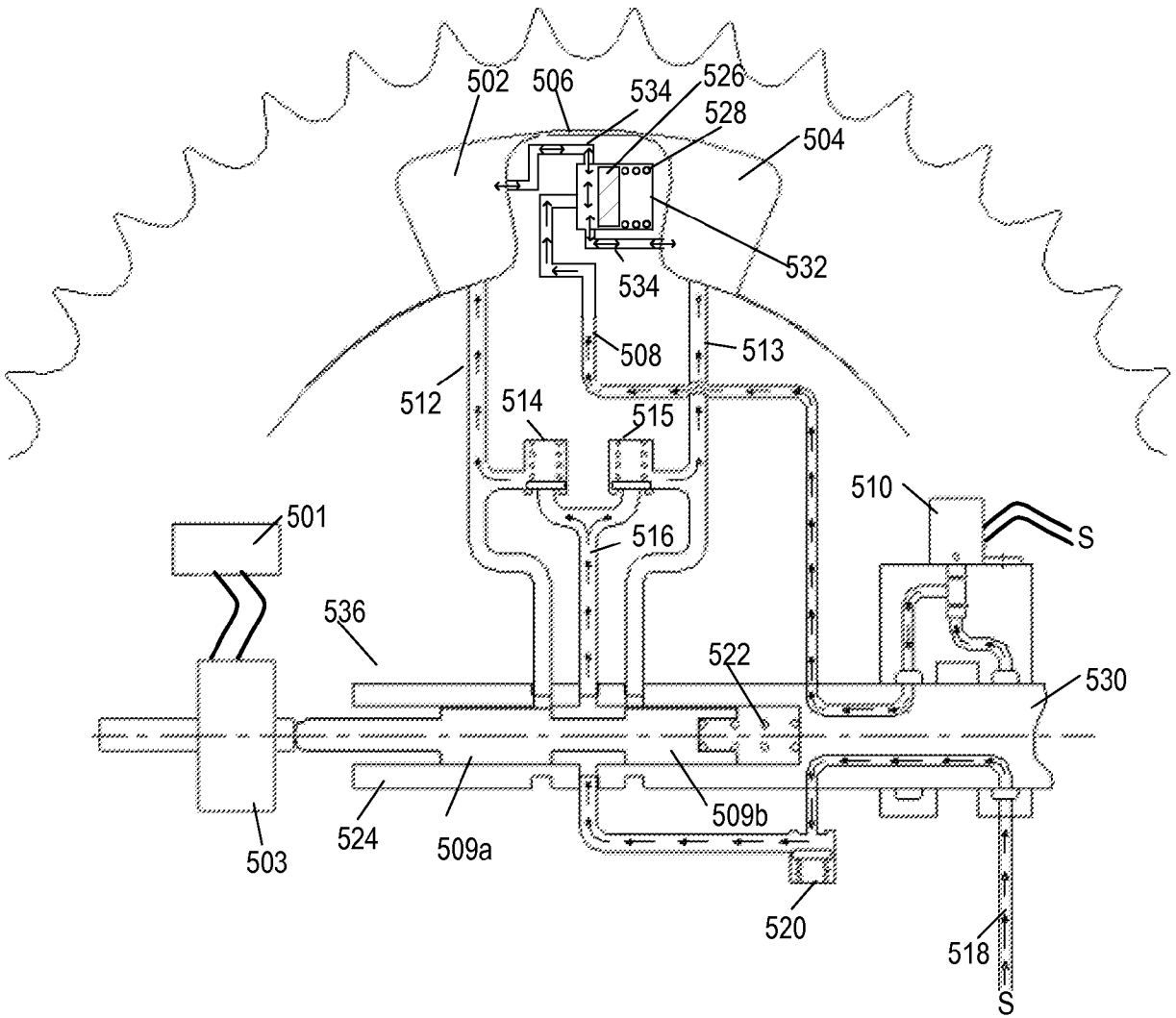
FIG. 7*b* shows of a phaser with a pressure actuated valve in the open position.

FIGS. 7*a* and 7*b* show the phaser in the null position, Fluid from a pressurized source supplies line 518, through check valve 520 to the spool valve or the control valve 536 with makeup fluid only. The spool valve 536 may be internally or externally mounted and comprises a sleeve 524 for receiving a spool 509 with lands 509*a*, 509*b* and a biasing spring 522. An actuator 503, which is controlled by the ECU 501, moves the spool 509 within the sleeve 524. From the spool valve 536, fluid enters supply line 516, which branches and leads to advance line 512 and retard line 513 and to the chambers 502, 504 through check valves 514, 515.

A pressure actuated valve, including a piston 526 biased by spring 528 is housed in an axial bore 532 of the vane 506. The vane 506 also includes a passage 534 extending across the vane 506 from the advance chamber 502 to the retard chamber 504, with the axial bore 532 connected to the passage 534 between the chambers 502,504. The pressure actuated valve is supplied by an on/off solenoid valve 510 connected to a pressurized source. The control of the pressure-actuated valve is independent of spool valve 509 control and position of the vane 506 itself. When the pressure-actuated valve is closed, no fluid is supplied from the on/off solenoid 510 to the axial bore 532 in the vane 506 through line 508. Furthermore, piston 526 of pressure actuated valve blocks the passage 534 and prevents any fluid from traveling between the advance chamber 502 and the retard chamber 504 through the passage 534.

FIG. 7*b* shows of a schematic of a phaser with a pressure-actuated valve in the open position. To open the pressure-actuated valve, the on/off solenoid 510 provides fluid to the axial bore 532 of the vane 506 via line 508. The pressure of the fluid is greater than the force of the spring 528 and the piston 526 retracts, allowing fluid passage between the advance chamber 502 and the retard chamber 504 through passage 534. When fluid passage is allowed between the advanced chamber 502 and the retard chamber 504, the camshaft 530 is retarded by negative cam torque prior to the valve opening and fluid is allowed to flow from the retard chamber 504 to the advance chamber 502. After the peak valve lift, the positive cam torque, due to the valve spring acting on the cam lobe (not shown), advances the cam during the closing half of the valve event and fluid flows from the advance chamber 502 back to the retard chamber 504. In other words, the phaser is actuated rapidly enough such that the camshaft is moved to the full retard position prior to peak valve lift, which then causes the camshaft torque to rapidly advance the camshaft during the closing half of the valve event or zero lift.

The pressure-actuated valve may also be added to the vane of an oil pressure actuated phaser and a torsion assist phaser.

Figure 8A:
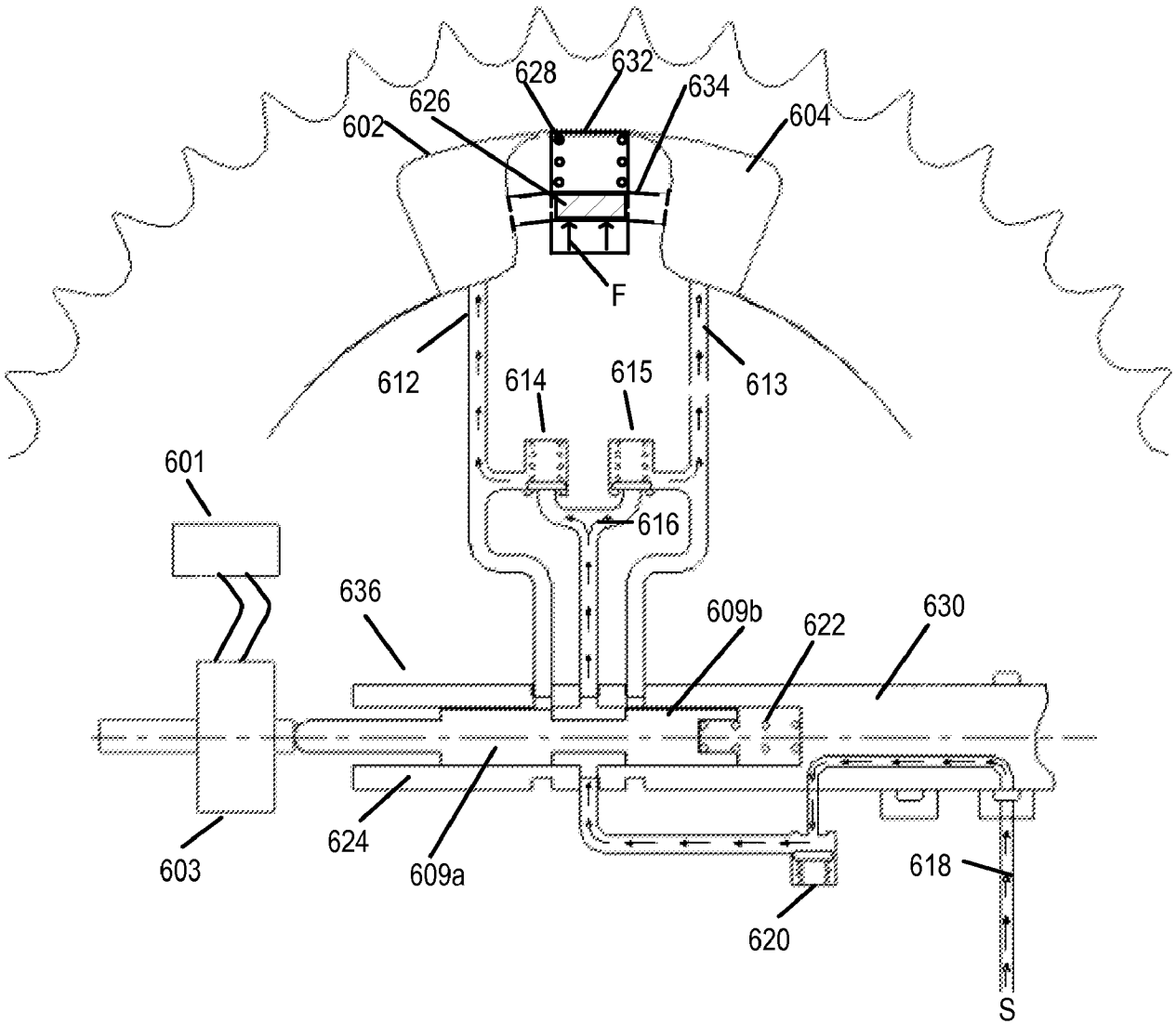
FIG. 8*a* shows a schematic of a phaser with a centrifugal valve in the vane in the closed position.

FIG. 8*a* shows a schematic of a cam torque actuated phaser in the null position with a centrifugal valve in the vane 606 in the closed position. In a conventional cam torque actuated phaser (CTA) torque reversals in the camshaft 630 caused by the forces of opening and closing engine valves move the vanes 606. The control valve in a CTA system allows the vanes 606 in the phaser to move by permitting fluid flow from the advance chamber 602 to the retard chamber 604 or vice versa, depending on the desired direction of movement. Cam torsionals are used to advance and retard the phaser (not shown). In the null position, the vane is locked in position. Makeup fluid is supplied to the phaser as is necessary.

Figure 8B:
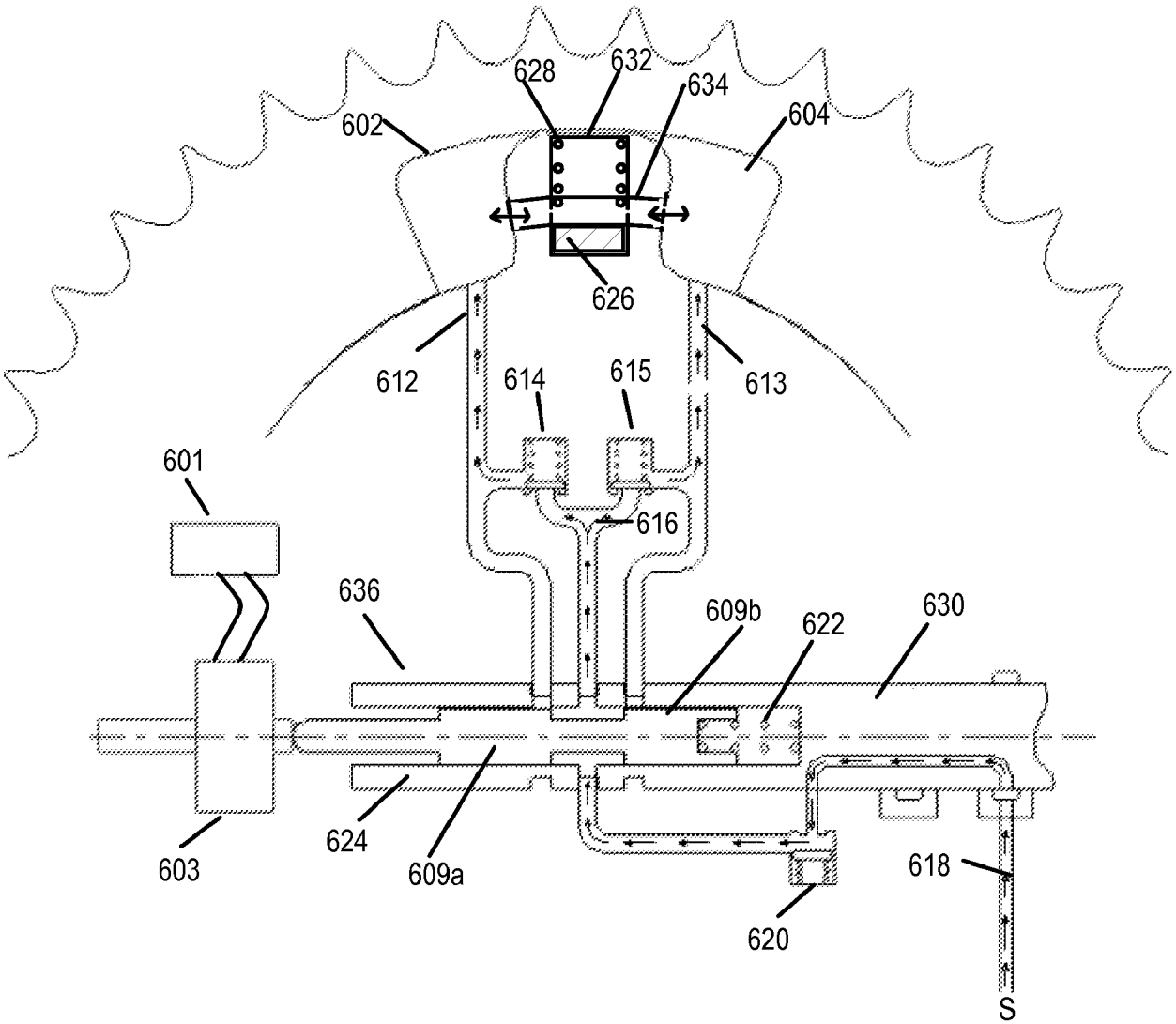
FIG. 8*b* shows a schematic of a phaser with a centrifugal valve in the vane in the open position.

FIGS. 8*a* and 8*b* show the phaser in the null position. Fluid from a pressurized source supplies line 618, through check valve 620 to the spool valve or control valve 636 with makeup fluid only. The spool valve 636 may be internally or externally mounted and comprises a sleeve 624 for receiving a spool 609 with lands 609*a*, 609*b* and a biasing spring 622. An actuator 603, which is controlled by the ECU 601, moves the spool 609 within the sleeve 624. From the spool valve 636, fluid enters supply line 616, which branches and leads to advance line 612 and retard line 613 and to the chambers 602, 604 through check valves 614, 615.

A centrifugal valve, including a piston 626 biased by a spring 628 is housed in an axial bore 632 of the vane 606. The vane 606 also includes a passage 634 extending across the vane 606 from the advance chamber 602 to the retard chamber 604, with the axial bore 632 connected to the passage 634 between the chambers 602,604. The centrifugal valve remains closed during high engine speeds, since the centrifugal force, indicated by arrow F, is great enough to bias spring 628. When the centrifugal valve is closed, piston 626 blocks the passage 634 and prevents any fluid from traveling between the advance chamber 602 and the retard chamber 604 through the passage 634.

The centrifugal valve is open during low engine speeds, since the centrifugal force is not greater than the biasing force of spring 628, as shown in FIG. 8*b*. With the centrifugal valve in the open position, fluid may pass between the advance chamber 602 and the retard chamber 604 through passage 634. When fluid passage is allowed between the advanced chamber 602 and the retard chamber 604, the camshaft 630 is retarded by negative cam torque prior to the valve opening and fluid is allowed to flow from the retard chamber 604 to the advance chamber 602. After the peak valve lift, the positive cam torque, due to the valve spring acting on the cam lobe (not shown), advances the cam during the closing half of the valve event and fluid flows from the advance chamber 602 back to the retard chamber 604. In other words, the phaser is actuated rapidly enough such that the camshaft is moved to the full retard position prior to peak valve lift, which then causes the camshaft torque to rapidly advance the phaser during the closing half of the valve event or zero lift. The position of the spool 609 is independent of whether the centrifugal valve is open or closed.

The centrifugal valve may also be added to the vane of an oil pressure actuated phaser and a torsion assist phaser.

Figure 9A:
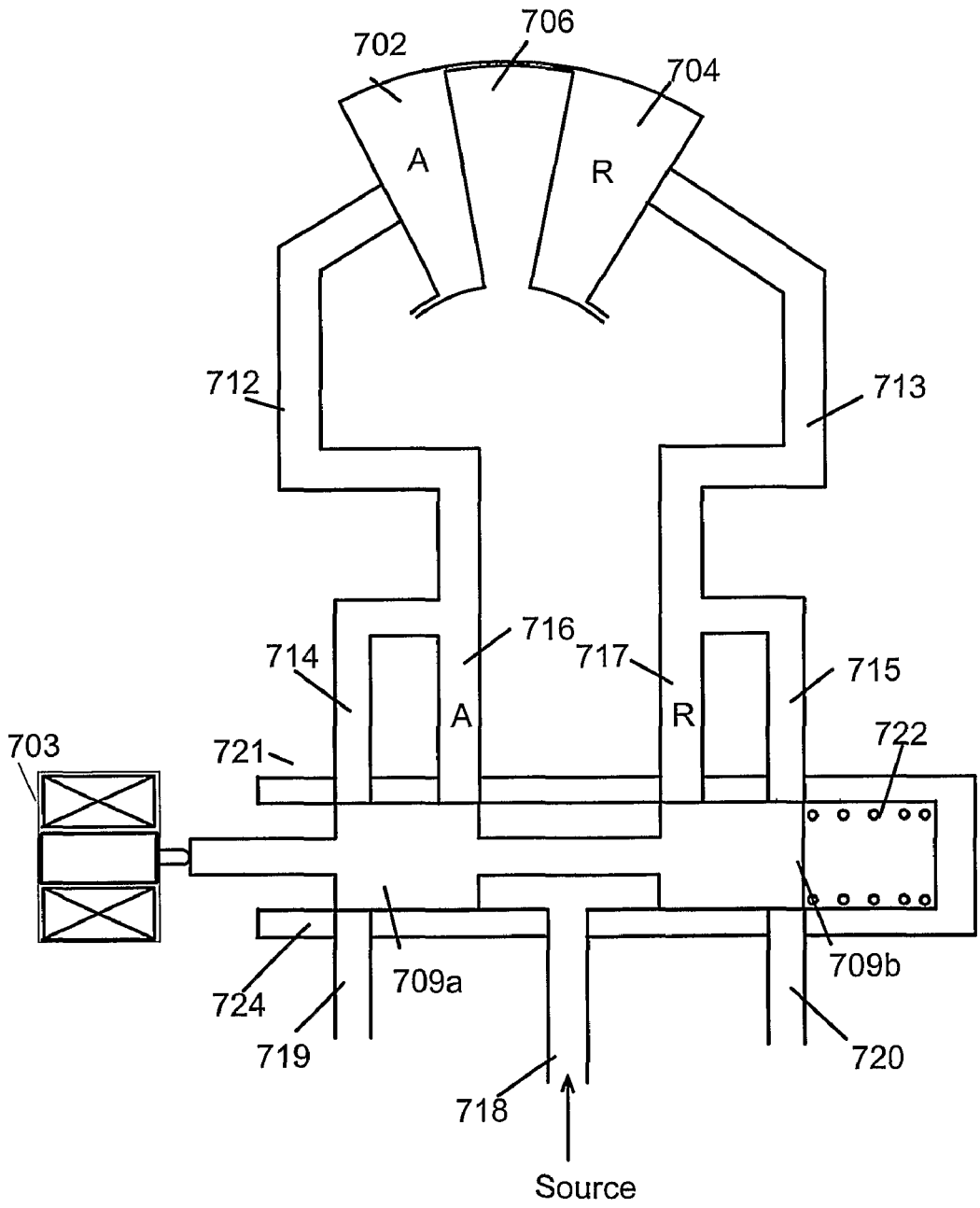
FIG. 9*a* shows a schematic of a phaser with high pressure and high response in the null position.
Figure 9B:
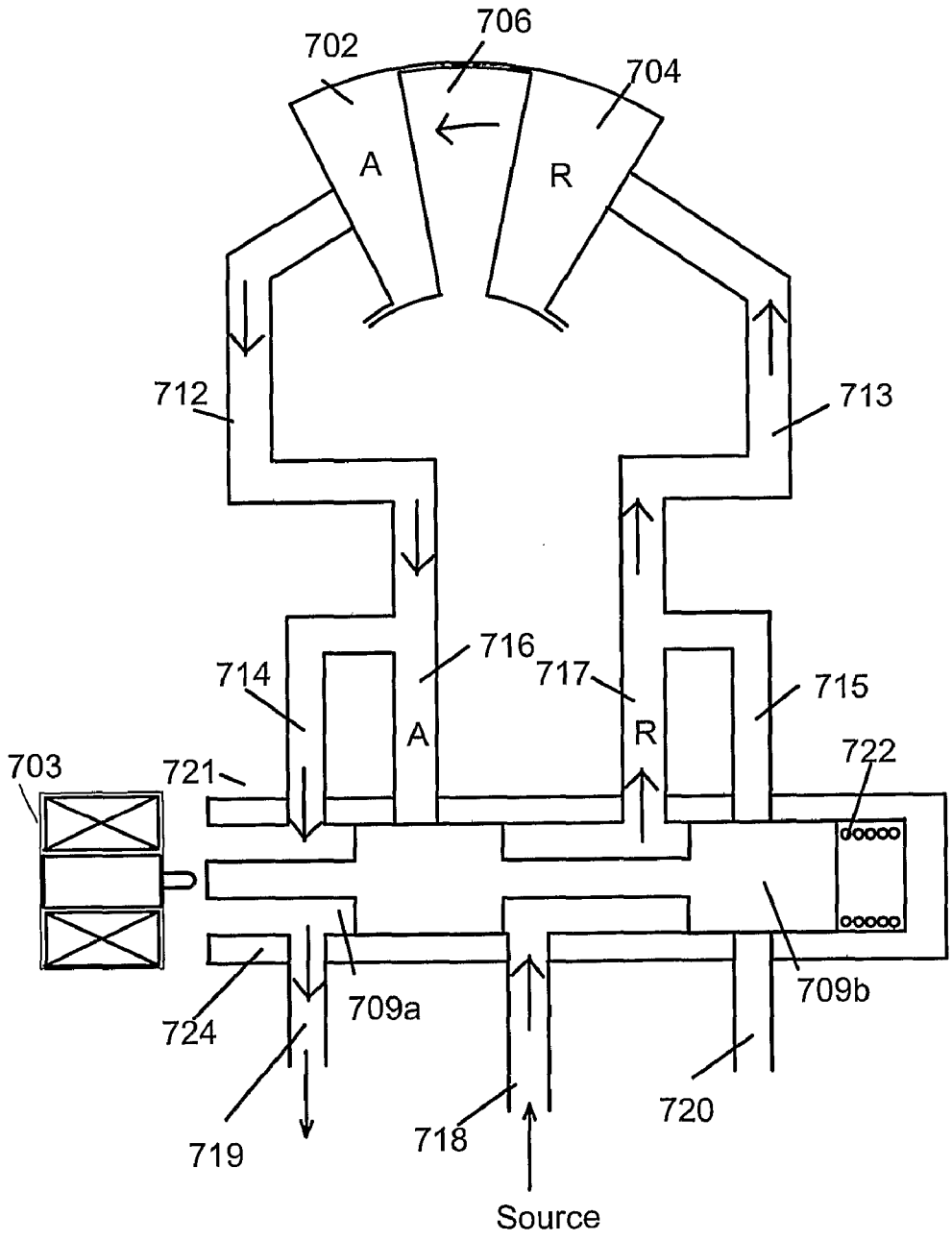
FIG. 9*b* shows a schematic of the phaser in the retard position.
Figure 9C:
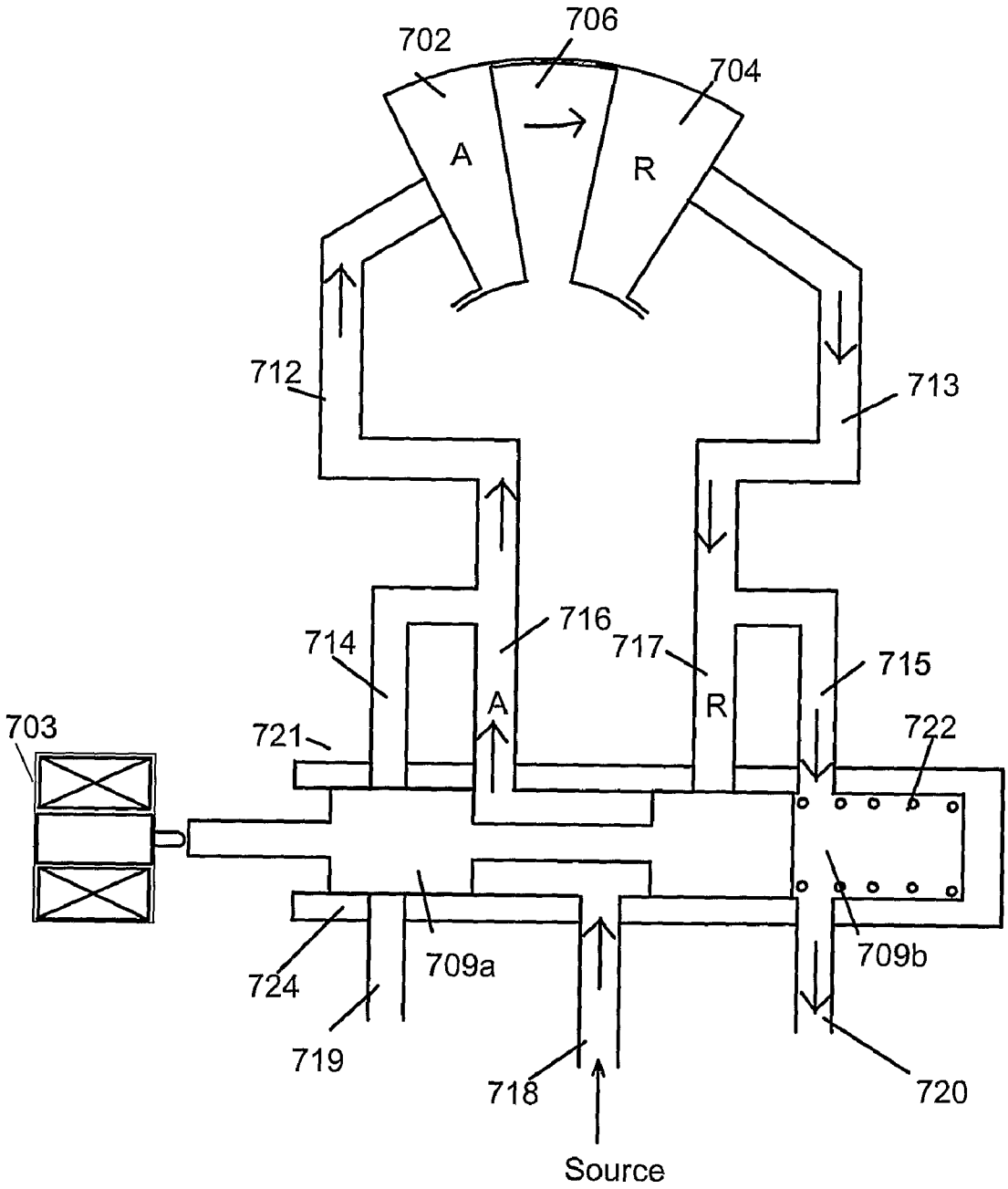
FIG. 9*c* shows a schematic of the phaser in the advance position.

FIGS. 9*a*-9*c* show an extremely high pressure, high response, oil pressure actuated phaser in the null position, the retard position, and the advance position. The high pressure and high response of the phaser allows the phaser to be actuated rapidly enough, such that the camshaft is moved to the full retard position prior to peak valve lift, which then causes the camshaft torque to rapidly advance the camshaft during the closing half of the valve event or zero lift. In oil pressure actuated phasers, engine oil pressure is applied to the advance chamber or the retard chamber, moving the vane. The control valve 721 may be internally or externally mounted and includes an actuator 703, which is controlled by an ECU (not shown), that moves the spool 709 with lands 709*a*, 709*b* within the sleeve 724 against the force of spring 722. Fluid from a highly pressurized, high response pump is supplied to the control valve by supply line 718. In the case of the null position, as shown in FIG. 9*a*, spool lands 709*a* and 709*b* block lines 714, 715, 716, 717 to the advance and retard chambers 702, 704.

When the phaser is in the retard position, shown in FIG. 9*b*, fluid from the spool valve enters 721 line 717 which leads to retard line 713 and the retard chamber 704. As the retard chamber 704 fills, the vane 706 moves to the left (as shown in this figure), causing the fluid in the advance chamber 702 to exit by advance line 712 to line 714 and to sump via line 719. Line 715 and line 720 to sump are blocked by spool land 709*b*. Line 716 is blocked by spool land 709*a*.

When the phaser is in the advance position, shown in FIG. 9*c*, fluid from the spool valve 721 enters line 716, which leads to advance line 712 and the advance chamber 702. As the advance chamber 702 fills, the vane 706 moves to the right (as shown in this figure), causing the fluid in the retard chamber 704 to exit by retard line 713 to line 715 and to sump via line 720. Line 714 and line 719 to sump are blocked by spool land 709*a*. Line 717 is blocked by spool land 709*b*.

Alternatively, a check valve may be added to supply line 718.

Figure 10A:
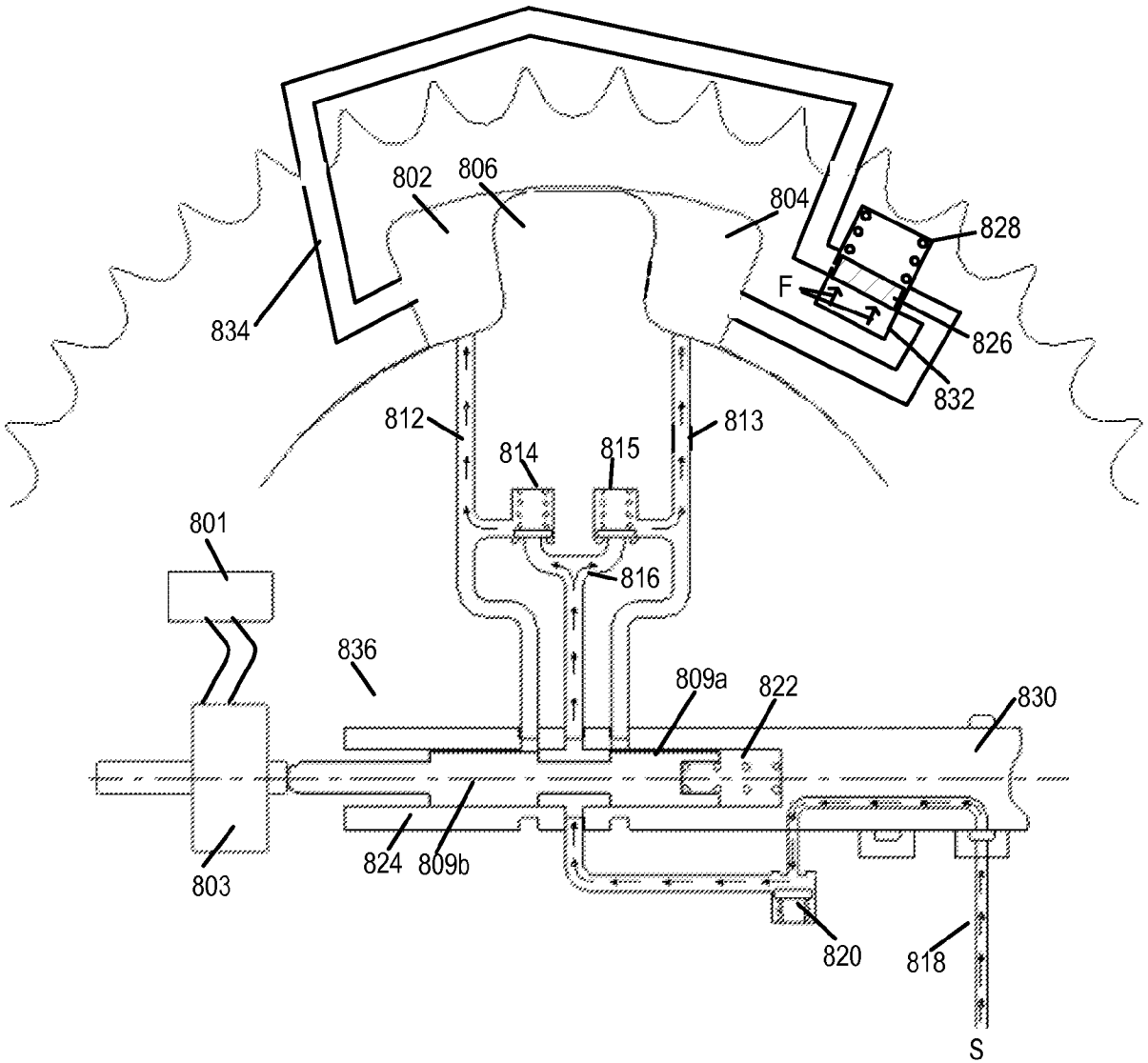
FIG. 10*a* shows a schematic of a phaser with a centrifugal valve in a closed position connected to the advance and retard chambers outside of the vane.

FIG. 10*a* shows a schematic of a cam torque actuated phaser in the null position with a centrifugal valve located in the housing 850 or outside of the phaser in the closed position. In a conventional cam torque actuated phaser (CTA) torque reversals in the camshaft 830 caused by the forces of opening and closing engine valves move the vanes 806. The control valve in a CTA system allows the vanes 806 in the phaser to move by permitting fluid flow from the advance chamber 802 to the retard chamber 804 or vice versa, depending on the desired direction of movement. Cam torsionals are used to advance and retard the phaser (not shown). In the null position, the vane is locked in position. Makeup fluid is supplied to the phaser as is necessary.

Figure 10B:
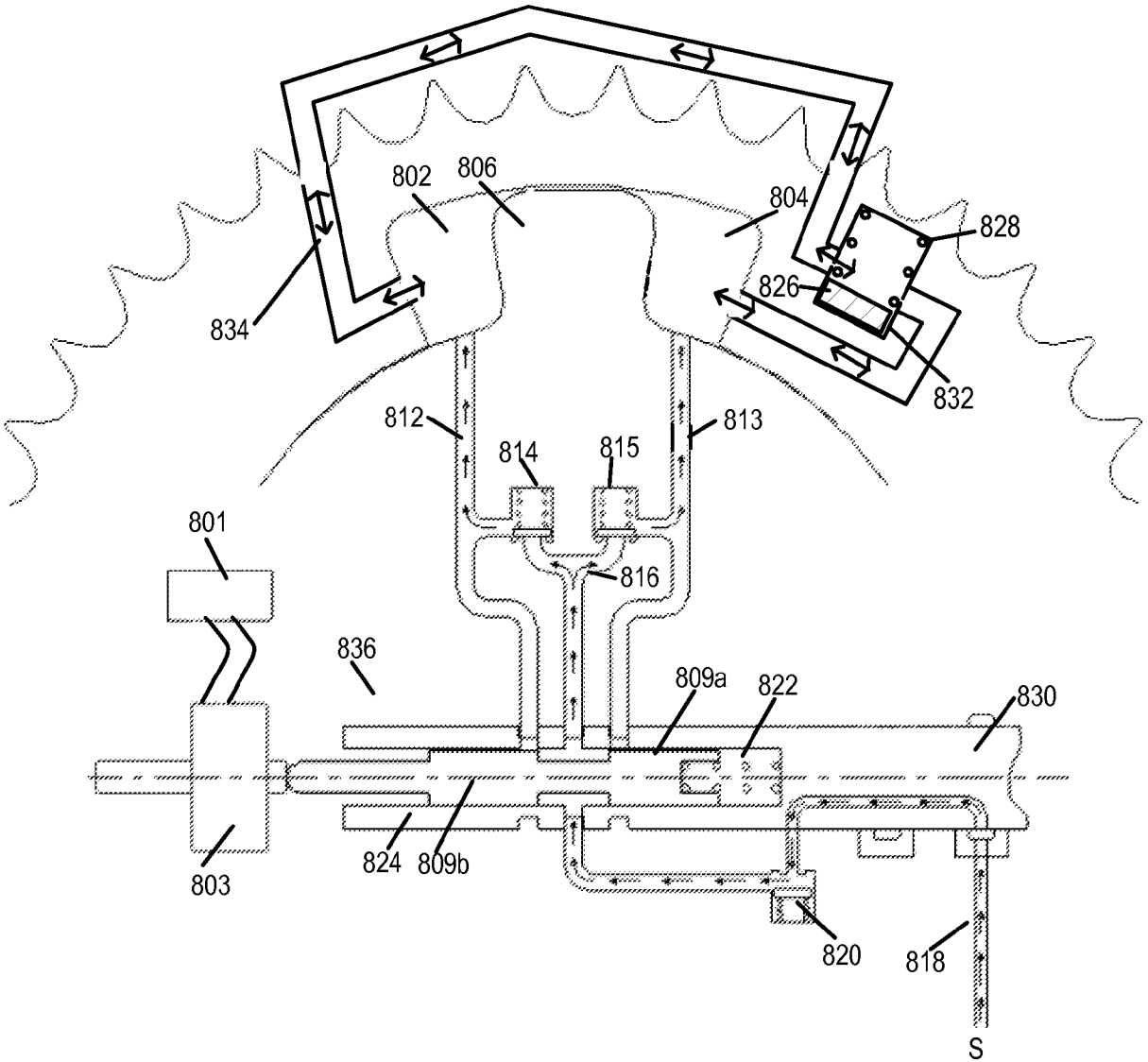
FIG. 10*b* shows a schematic of a phaser with a centrifugal valve in an open position connected to the advance and retard chambers outside of the vane.

FIGS. 10*a* and 10*b* show the phaser in the null position. Fluid from a pressurized source supplies line 818 through check valve 820 to the spool valve 836 with makeup fluid only. The spool valve 836 may be internally or externally mounted and comprises a sleeve 824 for receiving a spool 809 with lands 809*a*, 809*b*, and a biasing spring 822. An actuator 803, which is controlled by the ECU 801, moves the spool 809 within the sleeve 824. From the spool valve 836, fluid enters supply line 816, which branches and leads to advance line 812 and retard line 813, and to the chambers 802, 804 through check valves 814, 815.

A centrifugal valve, including a piston 826 biased by a spring 828 is housed in a bore 832 in the housing 850 or outside of the phaser. A passage or bypass 834 extends from the centrifugal valve to the advance chamber 802 and from the valve to the retard chamber 804. The centrifugal valve remains closed during high engine speeds, since the centrifugal force, indicated by arrows F, is great enough to bias spring 828. When the centrifugal valve is closed, piston 826 blocks the passage 834 and prevents any fluid from traveling between the advance chamber 802 and the retard chamber 804 through passage 834.

The centrifugal valve is open during low engine speeds, since the centrifugal force F is not greater than the biasing force of the spring 828, as shown in FIG. 10*b*. With the centrifugal valve in the open position, fluid may pass between the advance chamber 802 and the retard chamber 804 through passage 834. When fluid passage is allowed between the advanced chamber 802 and the retard chamber 804, the camshaft 830 is retarded by negative cam torque prior to the valve opening and fluid is allowed to flow from the retard chamber 804 to the advance chamber 802. After the peak valve lift, the positive cam torque, due to the valve spring acting on the cam lobe (not shown), advances the cam during the closing half of the valve event and fluid flows from the advance chamber 802 back to the retard chamber 804. In other words, the phaser is actuated rapidly enough such that the camshaft is moved to the full retard position prior to peak valve lift, which then causes the camshaft torque to rapidly advance the camshaft during the closing half of the valve event or zero lift. The position of the spool 809 is independent of whether the centrifugal valve is open or closed.

The centrifugal valve may also be added to the housing or outside of an oil pressure actuated phaser or a torsion assist phaser.

FIGS. 11*a*-11*d* shows schematics of a cam torque actuated phaser with an extended spool position or a valve event duration reduction (VEDR) position that reduces the valve event, by allowing rapid actuation of the camshaft to a full retard position and prior to peak valve lift, which then causes the camshaft torque to rapidly advance the camshaft during the closing half of the valve event. The housing, the rotor, the vane and the actuating means for the spool valve have not been shown.

Figure 11B:
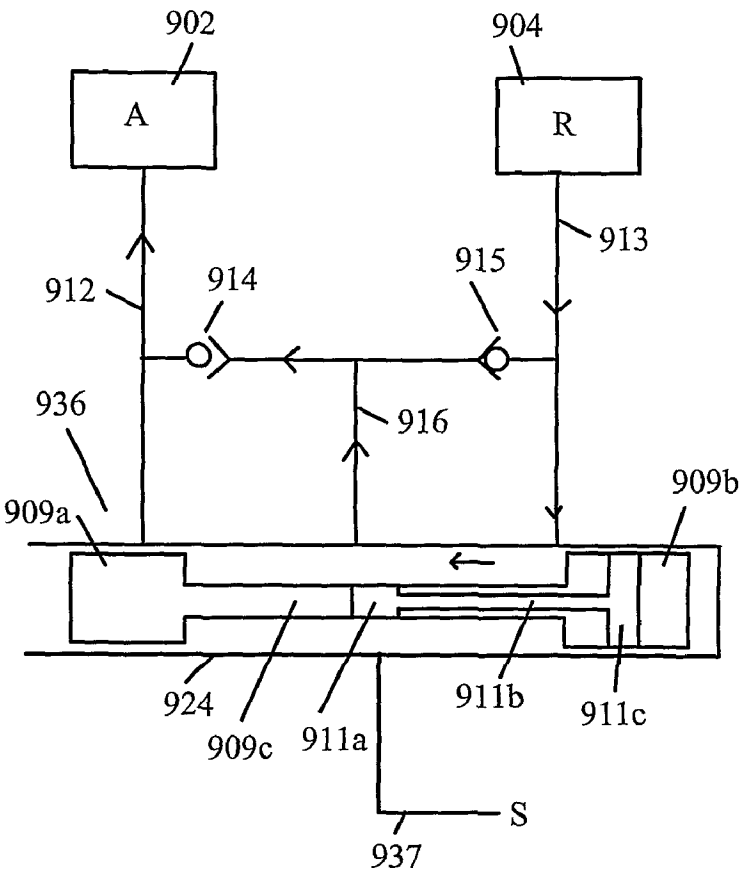
FIG. 11*b* shows a schematic of a cam torque actuated phaser with passages or a bypass between the lands of the spool in the advanced position.
Figure 11A:
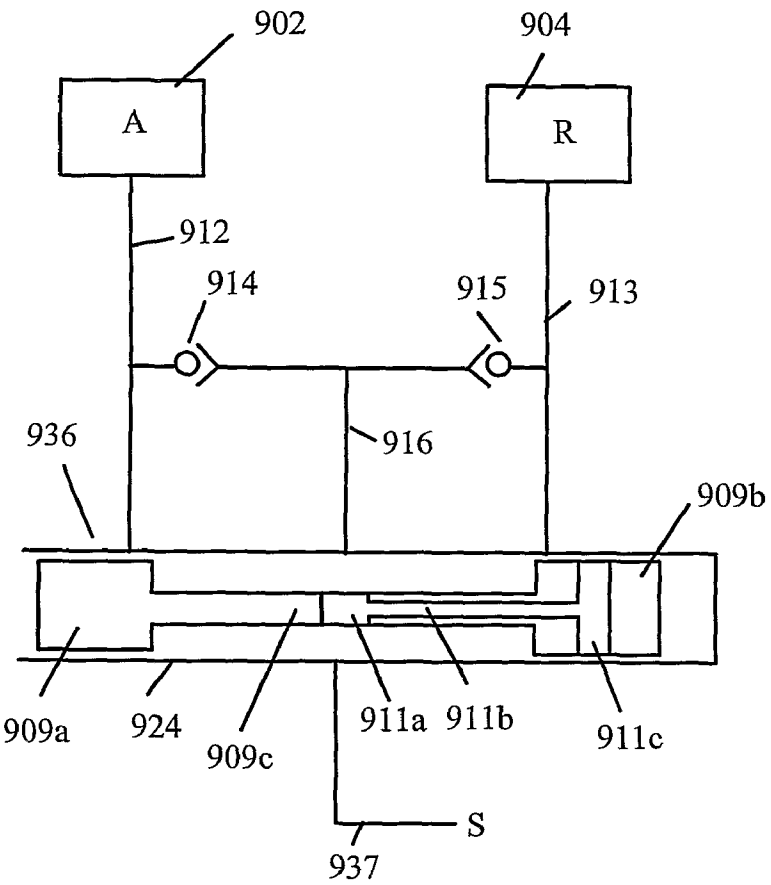
FIG. 11*a* shows a schematic of a cam torque actuated phaser with passages or a bypass between the lands of the spool in the null position.

FIG. 11*a* shows the phaser in the null position. In the null position, fluid is prevented from flowing out of the advanced chamber 902 and the retard chamber 904 by spool lands 909*a* and 909*b* respectively. In a conventional cam torque actuated phaser, torque reversals in the camshaft caused by the forces of opening and closing engine valves move the vanes. The control valve 936 in a CTA system allows the vanes in the phaser to move by permitting fluid flow from the advance chamber 902 to the retard chamber 904 or vice versa, depending on the desired direction of movement. Cam torsionals are used to advance and retard the phaser (not shown). In the null position, the vane is locked in position. Makeup fluid is supplied to the phaser as is necessary.

Figure 11D:
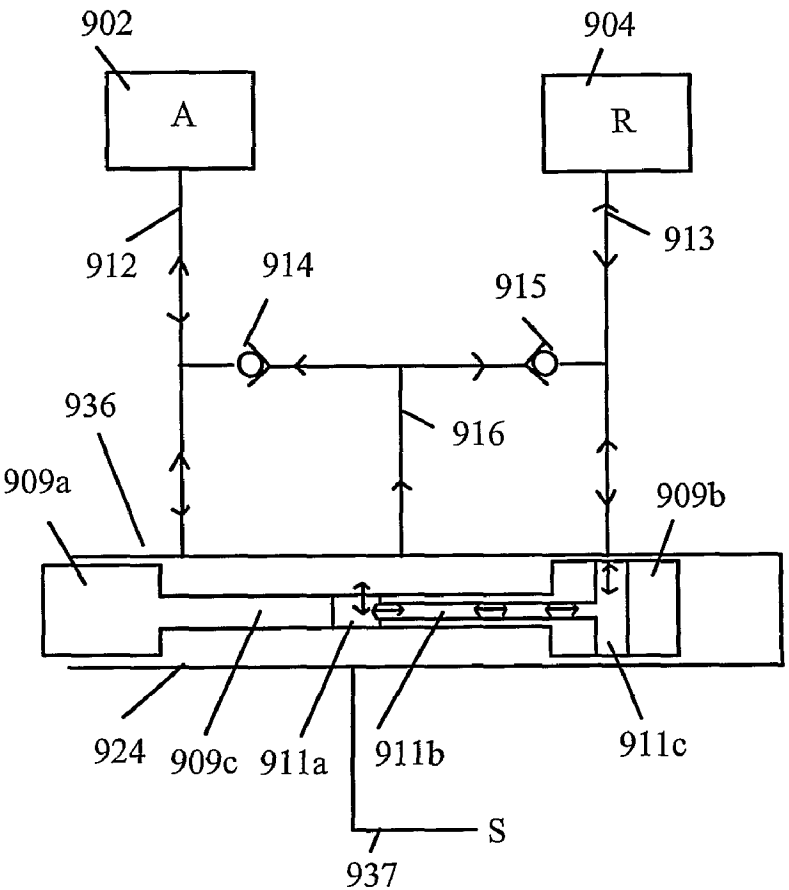
FIG. 11*d* shows a schematic of a cam torque actuated phaser with passages or a bypass between the lands of the spool in a valve event duration reduction position.

In the VEDR position, shown in FIG. 11*d*, the phaser is moved to a full retard position prior to peak valve lift, which then causes the camshaft torque to rapidly advance the camshaft during the closing half of the valve event or zero lift without having to move the spool position shown by the flow of fluid.

For the retarding of the phaser, fluid moves from the advance chamber 902 through line 912 to the spool valve 926. Fluid can flow to the retard chamber 904 by two different routes. In one route, fluid enters line 916 and through check valve 915 to line 913 and the retard chamber 904. In another route, fluid moves into a series of passages or a spool bypass 911, which routes fluid to line 913 and to the retard chamber 904. The spool bypass 911 extends from the spool body 909*c* defined between the first land 909*a* and the second land 909*b*, to the second spool land 909*b*. The spool bypass 911 is comprised of a first spool bypass portion 911*a* along the center of the spool body 909*c* extending the entire circumference of the spool body 909*c*. The first spool bypass portion 911*a* is in fluid communication with a second spool bypass portion 911*b* that extends from the first spool bypass portion 911*a* to a third bypass portion 911*c* in the second land 909*b*. The third spool bypass portion 911*c* extends the entire circumference of the second spool land 909*b*. From the third spool bypass portion 911*c* fluid flows to line 913 and to the retard chamber 904.

The phaser is then rapidly actuated to an advanced position. Fluid can flow to the advance chamber 902 by two different routes. In one route, fluid exits the retard chamber 904 through line 913 to the third spool bypass portion 911*c*. Fluid moves from the third spool bypass portion 911*c* to the second spool bypass portion 911*b* and to the first spool bypass portion 911*a*. From the first spool bypass portion 911*a*, fluid moves into line 916, through check valve 914 to line 912 and the advance chamber 902. In another route, fluid moves through the third spool bypass portion 911*c* to the second spool bypass portion 911*b* to the first spool bypass portion 911*a*. From the first spool bypass portion 911*a* fluid moves into line 912 and to the advance chamber 902.

In FIG. 11*b*, the advanced position shown does not receive fluid from the spool bypass 911. As in a conventional cam torque actuated phaser, the spool is positioned such that spool land 909*a* blocks the exit of fluid from line 912, and lines 913 and 916 are open. Camshaft torque pressurizes the advance chamber 902, causing fluid in the retard chamber 904 to move into the advance chamber 902. Fluid exiting the retard chamber 904 moves through line 913 and into the spool valve 936 between lands 909*a* and 909*b*. From the spool valve, the fluid enters line 916 and travels through open check valve 914 and into line 912 to the advance chamber 902.

Figure 11C:
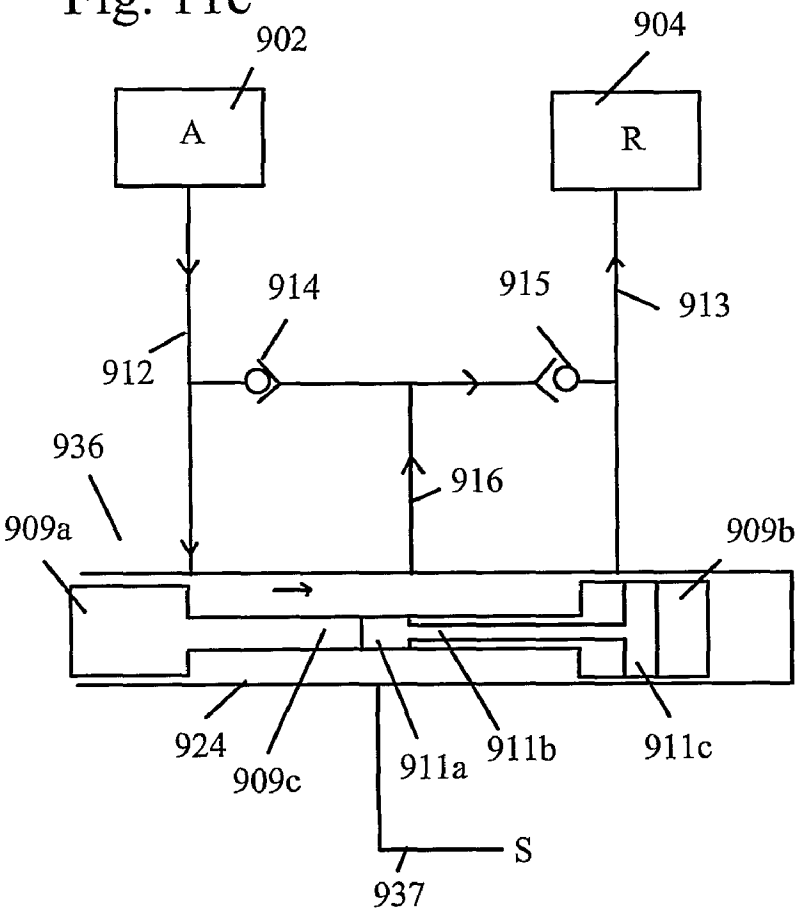
FIG. 11*c* shows a schematic of a cam torque actuated phaser with passages or a bypass between the lands of the spool in the retard position.

FIG. 11*c* shows the retard position, which also does not receive fluid from the spool bypass 911. As in a conventional cam torque actuated phaser, the spool is positioned such that spool land 909*b* blocks the exit of fluid from line 913, and lines 912 and 916 are open. Camshaft torque pressurizes the retard chamber 904, causing fluid in the advance chamber 902 to move into the retard chamber 904. Fluid exiting the advance chamber 902 moves through line 912 and into the spool valve 936 between spool lands 909*a* and 909*b*. From the spool valve, the fluid enters line 916 and travels through open check valve 915 and into line 913 to the retard chamber 904.

Makeup oil is supplied to the phaser by supply line 937, which is connected to a pressurized source of fluid.

FIGS. 12*a*-12*d* show schematics of an oil pressure actuated phaser with an extended spool position or a valve event duration reduction (VEDR) position that reduces the valve event, by allowing rapid actuation of the camshaft to a full retard position and prior to peak valve lift, which then causes the oil pressure to rapidly advance the camshaft during the closing half of the valve event. The housing, the rotor, the vane and the actuating means for the spool valve have not been shown.

Figure 12B:
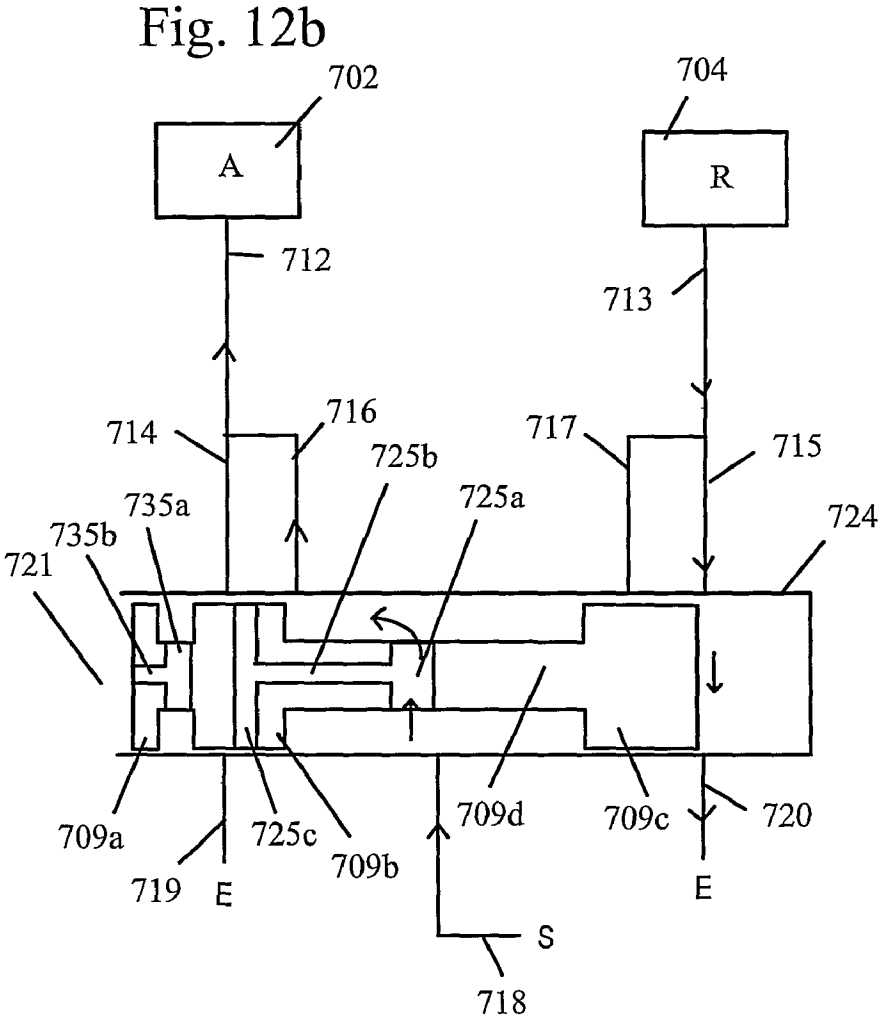
FIG. 12*b* shows a schematic of an oil pressure actuated phaser with passages or a bypass between the lands of the spool in the advanced position.
Figure 12A:
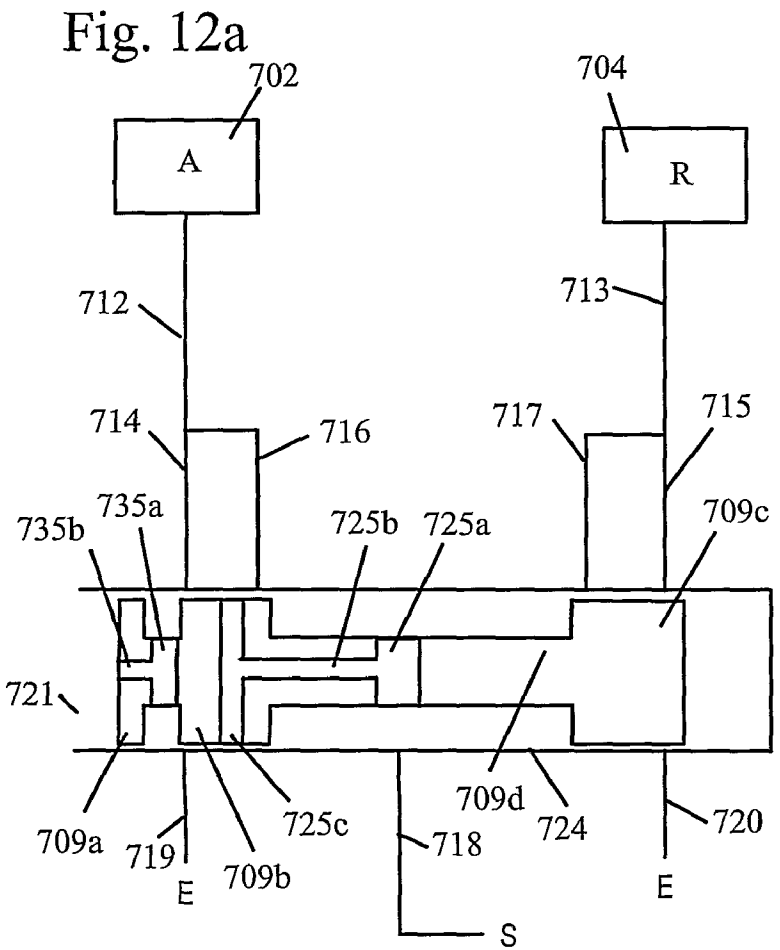
FIG. 12*a* shows a schematic of an oil pressure actuated phaser with passages or a bypass between the lands of the spool in the null position.

FIG. 12*a* shows the phaser in the null position. In the null position, fluid is prevented from flowing out of the advanced chamber 702 and the retard chamber 704 by spool lands 709*b* and 709*c* respectively. In a conventional oil pressure actuated phaser, fluid from the pressurized source is used to move the vanes.

Figure 12D:
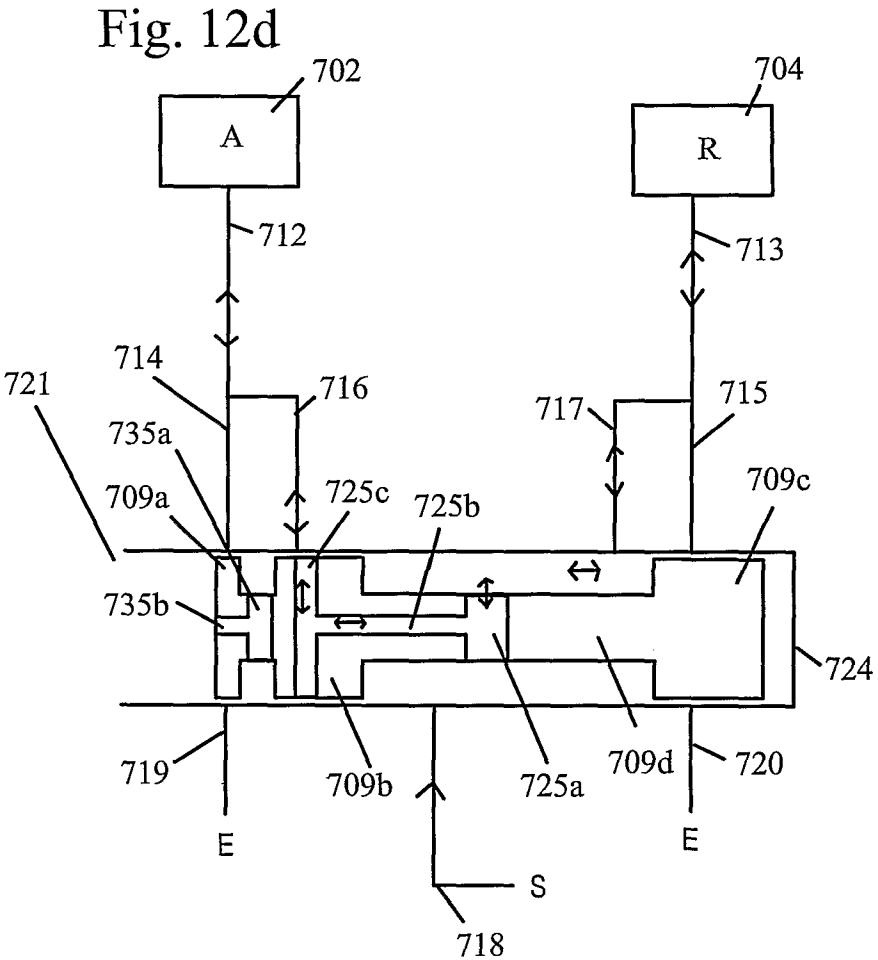
FIG. 12*d* shows a schematic of an oil pressure actuated phaser with passages or a bypass between the lands of the spool in the valve event duration reduction position.

In the VEDR position, shown in FIG. 12*d*, the phaser is moved to a full retard position prior to peak valve lift, which then causes the oil pressure to rapidly advance the camshaft during the closing half of the valve event or zero lift without having to move the spool position without having to move the spool position shown by the flow of fluid.

For retarding of the phaser, fluid moves from the advanced chamber 702 through line 712 to line 716. From line 716 fluid enters a series of passages or a spool bypass 725, which routes fluid to line 717 and to the retard chamber 704. The spool bypass 725 extends from the spool body 709*d* defined between the second land 709*b* and the third land 709*c*, to the second spool land 709*b*. The spool bypass 725 is comprised of a first spool bypass portion 725*a* along the center of the spool body 709*c*, defined between the second land 709*b* and the third land 709*c*, extending the entire circumference of the spool body 709*d*. The first spool bypass portion 725*a* is in fluid communication with a second spool bypass portion 725*b* that extends from the first spool bypass portion 725*a* to a third bypass portion 725*c* in the second land 709*b*. The third spool bypass portion 725*c* extends the entire circumference of the second spool land 709*b*. From the third spool bypass portion 725*c* fluid flows to line 717 and to the retard chamber 704. Fluid is also supplied from the pressurized source through line 718.

The phaser is then rapidly actuated to an advanced position. Fluid exits the retard chamber 704 through line 713 to line 717 and the spool valve 721. From line 717 fluid enters a series of passages or a spool bypass 725, which routes fluid to line 716 and to the advance chamber 702. Fluid moves from the third spool bypass portion 725*c* to the second spool bypass portion 725*b* and to the first spool bypass portion 725*a*. From the first spool bypass portion 725*a*, fluid moves into line 716 and to the advance chamber 702. Spool land 709*a* blocks fluid from entering the spool valve 721 from line 714 and exhausting to sump through line 719 and spool land 709*c* blocks fluid from entering or exiting the spool valve 721 from line 715 and exhausting to sump through line 720. Fluid is also supplied from the pressurized source through line 718.

In FIG. 12*b*, the advanced position shown does not receive fluid from the third spool bypass portion 725*c*. Instead, fluid is supplied from a pressurized source through line 718 to the spool valve. In the spool valve, fluid travels through the first spool bypass portion to line 716 and 712 to the advance chamber 702. Fluid in the retard chamber 704 exits the chamber through lines 713 and 715 to the spool valve 721 and then to line 720 leading to sump. Spool land 709*b* blocks fluid from entering or exiting the spool valve 721 from line 714 and exhausting to sump through line 719 and spool land 709*c* blocks fluid from entering or exiting the spool valve 721 from line 717.

Figure 12C:
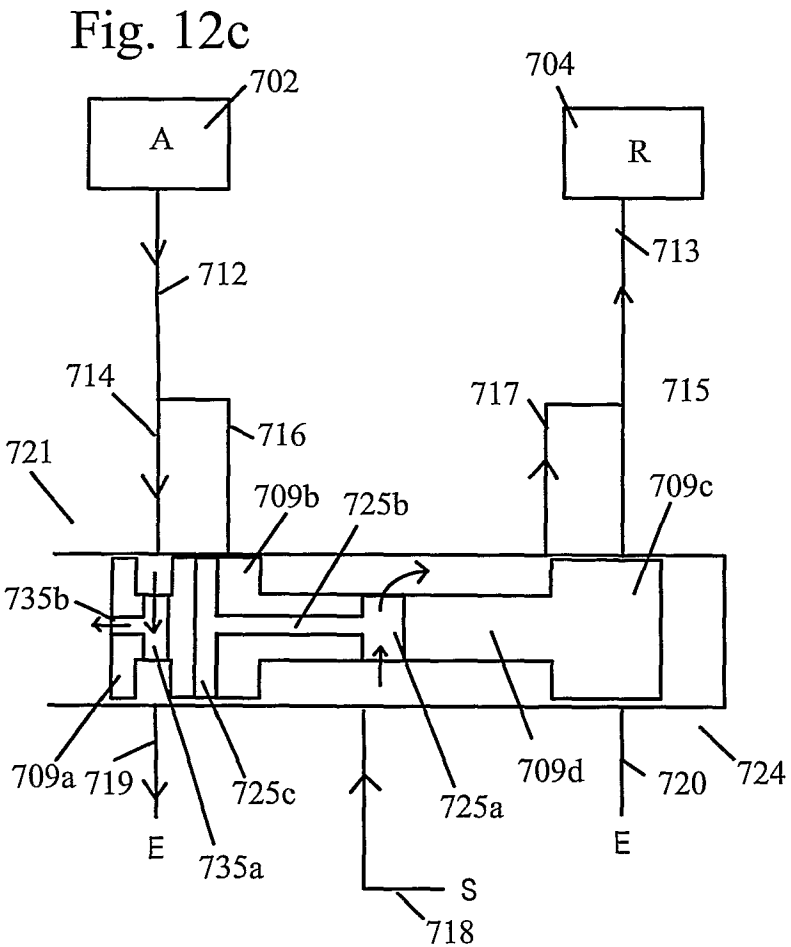
FIG. 12*c* shows a schematic of an oil pressure actuated phaser with passages or a bypass between the lands of the spool in the retard position.

FIG. 12*c* shows the oil pressure actuated phaser in the retard position. Fluid from supply line 718 enters the spool valve 721 and moves through the first portion of the spool bypass 725 to line 717 and then to line 713, leading to the retard chamber 704. Fluid from the advance chamber 702 exits the chamber through line 712 and 714 to the spool valve 721. Fluid in the spool valve 721 moves through a first portion of an exhaust bypass 735*a* defined as the spool body 709*d* between the first land 709*a* and the second land 709*b*. The exhaust bypass first portion is in fluid communication with an exhaust bypass second portion which extends through the center and leads to the end of spool land 709*a*. Fluid moves through the exhaust bypass first portion 735*a* to line 719 and sump or through the exhaust bypass second portion 735*b* leading to atmosphere. Spool land 709*b* blocks fluid from entering or exiting line 716 and spool land 709*c* blocks fluid from entering or exiting line 715 or exhausting to sump through line 720.

FIGS. 13*a* through 13*d* show schematics of a torsion assist phaser with an extended spool position or a valve event duration reduction (VEDR) position that reduces the valve event, by allowing rapid actuation of the camshaft to a full retard position and prior to peak valve lift, which then causes a combination or both camshaft torque and oil pressure to rapidly advance the camshaft during the closing half of the valve event. The housing, the rotor, the vane and the actuating means for the spool valve have not been shown.

Figure 13B:
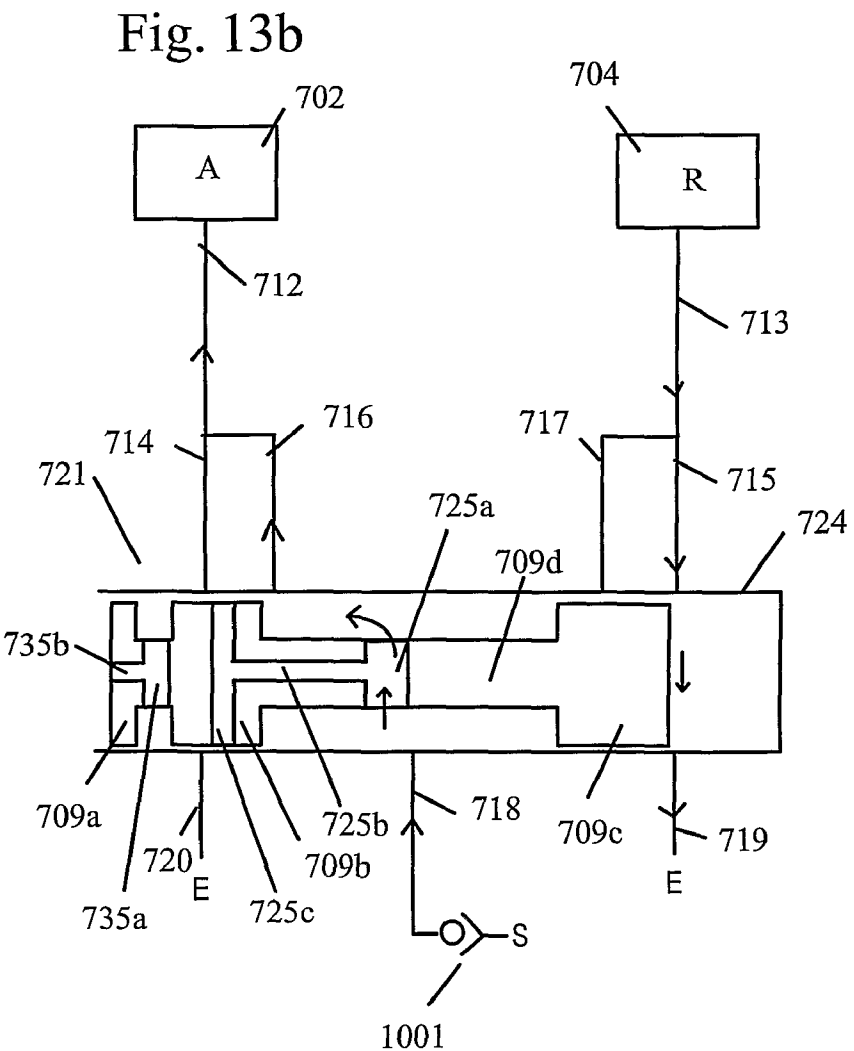
FIG. 13*b* shows a schematic of a torsion assist phaser with passages or a bypass between the lands of the spool in the advanced position.
Figure 13A:
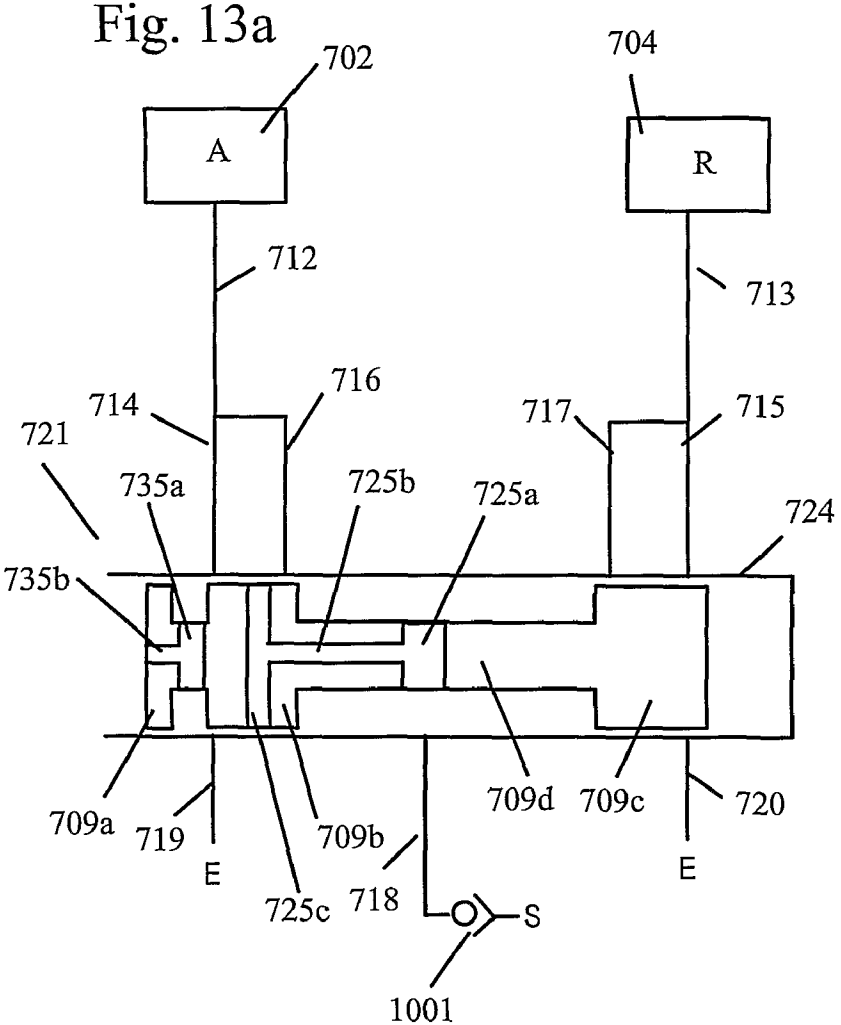
FIG. 13*a* shows a schematic of a torsion assist phaser with passages or a bypass between the lands of the spool in the null position.

FIG. 13*a* shows the phaser in the null position. In the null position, fluid is prevented from flowing out of the advanced chamber 702 and the retard chamber 704 by spool lands 709*b* and 709*c* respectively. In a conventional torsion assist phaser, fluid from the pressurized source and an inlet check valve 1001 is used to move the vanes.

Figure 13D:
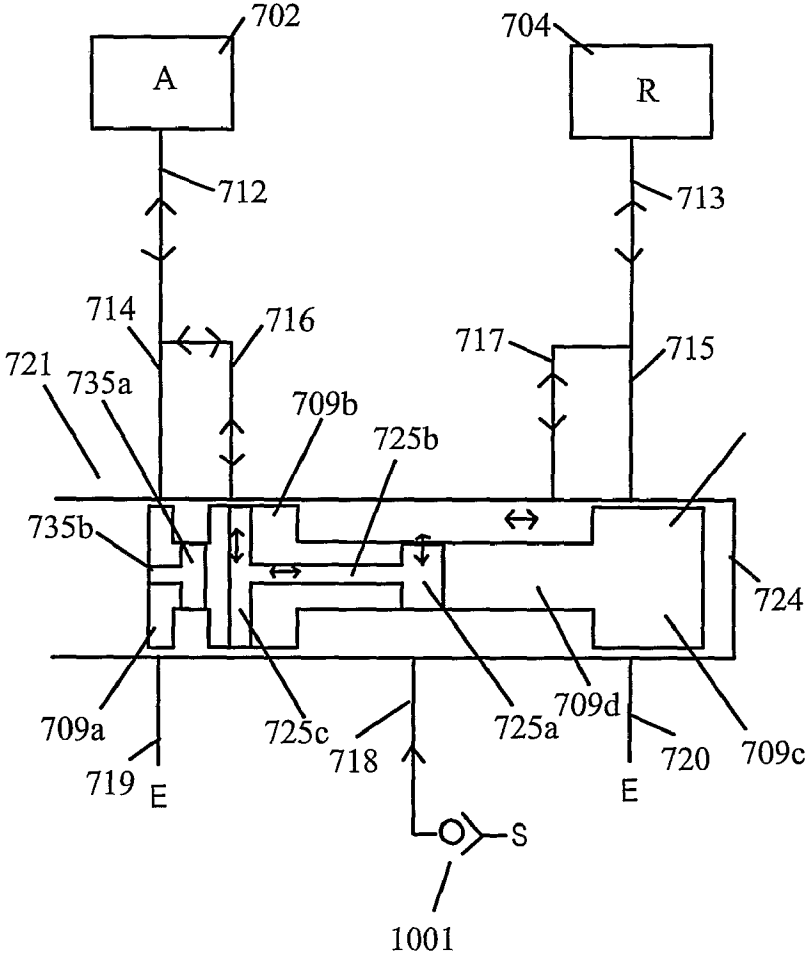
FIG. 13*d* shows a schematic of a torsion assist phaser with passages or a bypass between the lands of the spool in the valve event duration reduction position.

In the VEDR position, shown in FIG. 13*d*, the phaser is moved to a full retard position prior to peak valve lift, which then causes both camshaft torque and oil pressure to rapidly advance the camshaft during the closing half of the valve event or zero lift without having to move the spool position show by the flow of fluid.

For retarding of the phaser, fluid moves from the advanced chamber 702 through line 712 to line 716. From line 716 fluid enters a series of passages or a spool bypass 725, which routes fluid to line 717 and to the retard chamber 704. The spool bypass 725 extends from the spool body 709*d* defined between the second land 709*b* and the third land 709*c*, to the second spool land 709*b*. The spool bypass 725 is comprised of a first spool bypass portion 725*a* along the center of the spool body 709*c*, defined between the second land 709*b* and the third land 709*c*, extending the entire circumference of the spool body 709*d*. The first spool bypass portion 725*a* is in fluid communication with a second spool bypass portion 725*b* that extends from the first spool bypass portion 725*a* to a third bypass portion 725*c* in the second land 709*b*. The third spool bypass portion 725*c* extends the entire circumference of the second spool land 709*b*. From the third spool bypass portion 725*c* fluid flows to line 717 and to the retard chamber 704. Fluid is also supplied from the pressurized source through line 718 and inlet check valve 1001.

The phaser is then rapidly actuated to an advanced position. Fluid exits the retard chamber 704 through line 713 to line 717 and the spool valve 721. From line 717 fluid enters a series of passages or a spool bypass 725, which routes fluid to line 716 and to the advance chamber 702. Fluid moves from the third spool bypass portion 725*c* to the second spool bypass portion 725*b* and to the first spool bypass portion 725*a*. From the first spool bypass portion 725*a*, fluid moves into line 716 and to the advance chamber 702. Spool land 709*a* blocks fluid from entering the spool valve 721 from line 714 and exhausting to sump through line 719 and spool land 709*c* blocks fluid from entering or exiting the spool valve 721 from line 715 and exhausting to sump through line 720. Fluid is also supplied from the pressurized source through line 718 and inlet check valve 1001.

In FIG. 13*b*, the advanced position shown does not receive fluid from the third spool bypass portion 725*c*. Instead, fluid is supplied from a pressurized source through line 718 and an inlet check valve 1001 to the spool valve 721. In the spool valve, fluid travels through the first spool bypass portion to line 716 and 712 to the advance chamber 702. Fluid in the retard chamber 704 exits the chamber through lines 713 and 715 to the spool valve 721 and then to line 720 leading to sump. Spool land 709*b* blocks fluid from entering or exiting the spool valve 721 from line 714 and exhausting to sump through line 719 and spool land 709*c* blocks fluid from entering or exiting the spool valve 721 from line 717.

Figure 13C:
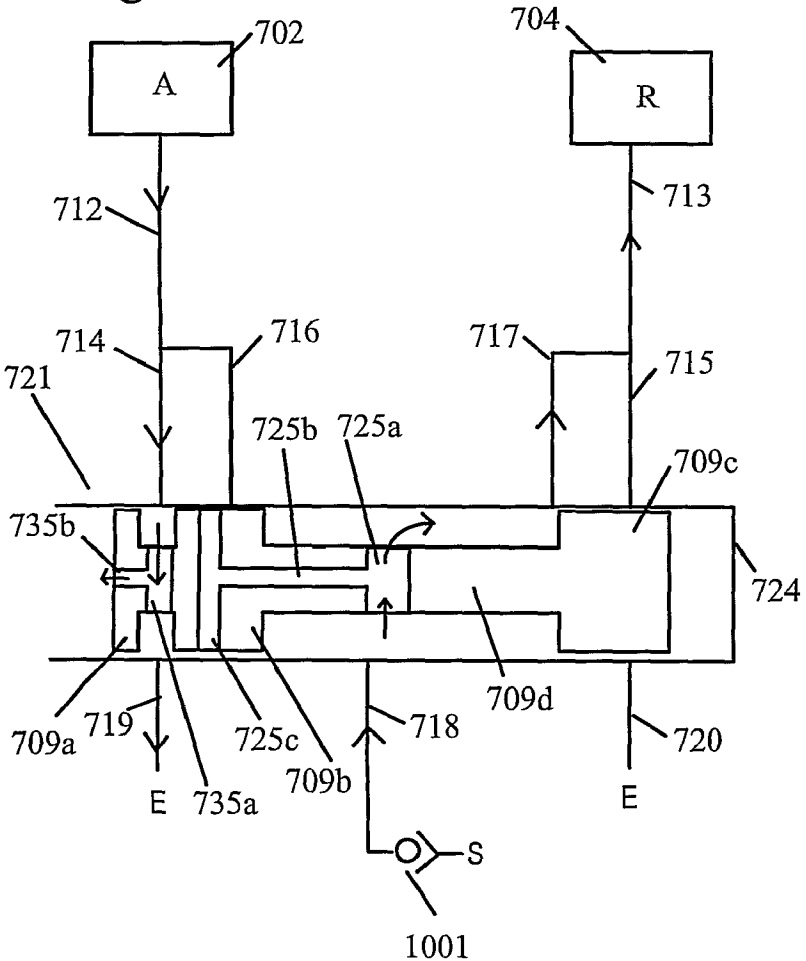
FIG. 13*c* shows a schematic of a torsion assist phaser with passages or a bypass between the lands of the spool in the retard position.

FIG. 13*c* shows the torsion assist phaser in the retard position. Fluid from supply line 718 and an inlet check valve 1001 enters the spool valve 721 and moves through the first portion of the spool bypass 725 to line 717 and then to line 713, leading to the retard chamber 704. Fluid from the advance chamber 702 exits the chamber through line 712 and 714 to the spool valve 721. Fluid in the spool valve 721 moves through a first portion of an exhaust bypass 735*a* defined as the spool body 709*d* between the first land 709*a* and the second land 709*b*. The exhaust bypass first portion 735*a* is in fluid communication with an exhaust bypass second portion 735*b* which extends through the center of and leads to the end of spool land 709*a*. Fluid moves through the exhaust bypass first portion 735*a* to line 719 and sump or through the exhaust bypass second portion 735*b* leading to atmosphere. Spool land 709*b* blocks fluid from entering or exiting line 716 and spool land 709*c* blocks fluid from entering or exiting line 715 or exhausting to sump through line 720.

Alternatively, the valve event may be extended by advancing the opening of the valve and retarding the closing of the valve as shown in FIG. 1 by the dotted, dashed line. Furthermore, during cold-start cranking the intake valve opening would be advanced and the intake valve closing would be retarded. During initial cold running, the intake valve opening is partially retarded. During hot idle, the intake valve opening would be advanced and the intake valve closing would be retarded. During low speed part-throttle, the intake valve opening would be advanced and the intake valve closing would be retarded.

Any of the phasers shown in FIGS. 7*a* through 13*d* may be used to lengthen or extend the valve event.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine having at least one camshaft with an intake or exhaust valve comprising:

a housing having an outer circumference for accepting drive force and chambers;

a rotor for connection to a camshaft coaxially located within the housing, the housing and the rotor defining at least one vane separating a chamber in the housing into an advance chamber and a retard chamber; the vane being capable of rotation to shift the relative angular position of the housing and the rotor;

a controlled bypass valve providing fluid communication between the advance and retard chambers, wherein when the controlled bypass valve is closed, the control bypass valve blocks the passage between the advance chamber and the retard chamber and wherein when the controlled bypass valve is open, fluid flows through the passage extending from the advance chamber to the retard chamber, such that the phaser and the camshaft are moved to a first position during the intake or exhaust valve opening, prior to the intake or exhaust valve reaching peak lift and such that camshaft torque, oil pressure or a combination of camshaft torque and oil pressure rapidly moves the phaser and the camshaft to a second position prior to the intake or exhaust valve reaching zero lift.

2. The phaser of claim 1, wherein the controlled bypass valve comprises a passage extending from the advance chamber to the retard chamber and a bypass valve received in a radial bore comprising a piston and spring.

3. The phaser of claim 2, further comprising a pressurized source line for providing fluid to the bypass valve, wherein when fluid is supplied to the bypass valve via the pressurized source line, the bypass valve is open.

4. The phaser of claim 2, wherein spring force of the spring of the bypass valve is chosen such that at certain speeds the bypass valve is open.

5. The phaser 1 of claim 1, wherein the controlled bypass valve is in the vane.

6. The phaser of claim 1, wherein the controlled bypass valve is in the housing.

7. The phaser of claim 1, wherein the first position of the intake or exhaust valve is a full retard position and the second position of the intake or exhaust valve is a full advance position.

8. The phaser of claim 1, wherein the phaser is a cam torque actuated phaser, a torsion assist phaser, or a oil pressure actuated phaser.

9. A variable cam timing phaser for an internal combustion engine having at least one camshaft with an intake or exhaust valve comprising:

a housing having an outer circumference for accepting drive force;

a rotor for connection to a camshaft coaxially located within the housing, the housing and the rotor defining at least one vane separating a chamber in the housing into an advance chamber and a retard chamber; the vane being capable of rotation to shift the relative angular position of the housing and the rotor;

a phase control valve for selectively directing fluid flow to the advance chamber or the retard chamber to shift the relative angular position of the rotor relative to the housing and blocking reverse fluid flow comprising a spool having a plurality of lands spaced along a spool body slidably received in a bore of the rotor and a spool bypass having:

a first spool bypass portion on the spool body between a first land and a second land around a circumference of the spool body; and a third spool bypass portion around a circumference of the second land in fluid communication with the first spool bypass portion through a second bypass portion;

wherein when the spool is moved to an extended spool position relative to the bore in the rotor, fluid flowing into and out of the retard chamber passes through the spool bypass, such that the phaser and the camshaft are moved to a full retard position during the intake or exhaust valve opening prior to the intake or exhaust a valve reaching peak lift and such that camshaft torque rapidly moves the phaser and the camshaft to a full advance position prior to the intake or exhaust valve reaching zero lift.

10. The phaser of claim 9, further comprising a passage connected to a pressurized fluid source for supplying makeup fluid to the advance chamber and the retard chamber.

11. A variable cam timing phaser for an internal combustion engine having at least one camshaft with an intake or exhaust valve comprising:

a housing having an outer circumference for accepting drive force and chambers;

a rotor for connection to a camshaft coaxially located within the housing, the housing and the rotor defining at least one vane separating a chamber in the housing into an advance chamber and a retard chamber; the vane being capable of rotation to shift the relative angular position of the housing and the rotor;

a phase control valve for directing fluid flow from a pressurized fluid source to shift the relative angular position of the rotor relative to the housing comprising:

a spool having a plurality of lands spaced along a spool body slidably received in a bore of the rotor;

a spool bypass having:

a first spool bypass portion on the spool body between a second land and a third land around a circumference of the spool body; and a third spool bypass portion around a circumference of the third land in fluid communication with the first spool bypass portion through a second bypass portion;

an exhaust spool bypass comprising:

a first exhaust spool bypass portion on the spool body between a first land and the second land around a circumference of the spool body; and a second exhaust spool bypass portion in fluid communication with the first exhaust spool bypass portion extending from the first exhaust spool bypass portion to an end of the spool vented to atmosphere;

wherein when the spool is moved to an extended spool position relative to the bore in the rotor, fluid flowing into and out of the advance chamber passes through the spool bypass, such that the phaser and the camshaft are moved to a full retard position during the intake or exhaust valve opening prior to the intake or exhaust valve reaching peak lift and such that camshaft torque rapidly moves the phaser and the camshaft to a full advance position prior to the intake or exhaust valve reaching zero lift.

12. The phaser of claim 11, wherein when the spool is moved to a retard position, fluid exits from the advance chamber through the first exhaust spool bypass to a line leading to sump and through the second exhaust spool bypass to atmosphere.

13. The phaser of the claim 11, further comprising a check valve between the phase control valve and the pressurized fluid source, allowing fluid flow into the phase control valve only.

* * * * *